US009013375B2

(12) United States Patent
Yoo

(10) Patent No.: US 9,013,375 B2
(45) Date of Patent: Apr. 21, 2015

(54) ORGANIC LIGHT-EMITTING DISPLAY APPARATUS AND METHOD OF DRIVING THE SAME

(75) Inventor: Myoung-Hwan Yoo, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 485 days.

(21) Appl. No.: 13/328,134

(22) Filed: Dec. 16, 2011

(65) Prior Publication Data

US 2012/0235973 A1 Sep. 20, 2012

(30) Foreign Application Priority Data

Mar. 16, 2011 (KR) ..... 10-2011-0023427

(51) Int. Cl.
*G09G 3/30* (2006.01)
*G09G 3/32* (2006.01)

(52) U.S. Cl.
CPC ..... *G09G 3/3233* (2013.01); *G09G 2300/0852* (2013.01); *G09G 2310/0251* (2013.01); *G09G 2320/045* (2013.01); *G09G 2330/028* (2013.01)

(58) Field of Classification Search
CPC ..... G09G 3/3233; G09G 2300/0852; G09G 2330/028; G09G 2320/045; G09G 2310/0251
USPC ..... 345/76, 211
See application file for complete search history.

(56) References Cited

U.S. PATENT DOCUMENTS

| | | | | |
|---|---|---|---|---|
| 6,239,625 | B1 * | 5/2001 | Abe | 327/58 |
| 7,755,925 | B2 * | 7/2010 | Chen et al. | 365/154 |
| 2006/0033551 | A1 * | 2/2006 | Dong et al. | 327/427 |
| 2006/0279356 | A1 | 12/2006 | An | |
| 2007/0195054 | A1 | 8/2007 | Kwon | |
| 2009/0140661 | A1 * | 6/2009 | Park et al. | 315/169.3 |
| 2010/0141850 | A1 * | 6/2010 | Itoh | 348/731 |
| 2010/0149152 | A1 | 6/2010 | Yamamoto et al. | |
| 2011/0025671 | A1 * | 2/2011 | Lee | 345/211 |

FOREIGN PATENT DOCUMENTS

| | | | |
|---|---|---|---|
| JP | 2010-145581 | A | 7/2010 |
| KR | 10-2006-0124432 | A | 12/2006 |
| KR | 0712553 | B1 | 4/2007 |
| KR | 10-2008-0020230 | A | 3/2008 |
| KR | 10-2011-0013693 | A | 2/2011 |

* cited by examiner

*Primary Examiner* — Ram Mistry
(74) *Attorney, Agent, or Firm* — Lee & Morse, P.C.

(57) ABSTRACT

An organic light-emitting display apparatus, including: a plurality of pixels each including an organic light-emitting diode (OLED); and a power supply voltage driving unit generating a first power supply voltage have a first level that varies according to time and a second power supply voltage having a second level that varies according to time, the power supply voltage driving unit supplying the first and the second power supply voltages to the plurality of pixels, wherein the power supply voltage driving unit includes: a first resistor connected to a gate of a second transistor for pulling-down the first power supply voltage, and a second resistor connected to a gate of a fourth transistor for pulling-down the second power supply voltage.

19 Claims, 24 Drawing Sheets

ORGANIC LIGHT-EMITTING DISPLAY APPARATUS AND METHOD OF DRIVING THE SAME

CROSS-REFERENCE TO RELATED PATENT APPLICATION

This application claims the benefit of Korean Patent Application No. 10-2011-0023427, filed on Mar. 16, 2011, in the Korean Intellectual Property Office, the disclosure of which is incorporated herein in its entirety by reference.

BACKGROUND OF THE INVENTION

1. Field of the Invention

One or more embodiments relate to an organic light-emitting display apparatus and a method of driving the same.

2. Description of the Related Art

Various types of flat panel display apparatuses have been recently developed that reduce weight and volume. Weight and volume are disadvantages of cathode ray tubs (CRTs), have been recently developed. Flat panel display apparatuses may include liquid crystal display (LCD) apparatuses, field emission display (FED) apparatuses, plasma display panel (PDP) apparatuses, organic light-emitting display apparatuses, etc.

Among flat panel display apparatuses, organic light-emitting display apparatuses display images on an organic light-emitting diode (OLED) by generating light due to the recombination of electrons and holes. Organic light-emitting display apparatuses have fast response speeds and are driven with low power consumption.

SUMMARY OF THE INVENTION

One or more embodiments are directed to an organic light-emitting display apparatus, and a method of driving the same.

According to an embodiment, there may be an organic light-emitting display apparatus including: a plurality of pixels each including an organic light-emitting diode (OLED); and a power supply voltage driving unit generating a first power supply voltage having a first level that varies according to time and a second power supply voltages having a second level that varies according to time, the power supply voltage driving unit supplying the first and the second power supply voltages to the plurality of pixels, wherein the power supply voltage driving unit includes: a first resistor connected to a gate of a second transistor for pulling-down the first power supply voltage; and a second resistor connected to a gate of a fourth transistor for pulling-down the second power supply voltage.

The power supply voltage driving unit may include: a first power supply voltage generation unit generating and outputting the first power supply voltage; and a second power supply voltage generation unit generating and outputting the second power supply voltage, and wherein the first power supply voltage generation unit includes: a first transistor including a gate connected to a first power supply voltage control signal, a first terminal connected to a direct current (DC) power supply voltage, and a second terminal connected to a first output line of the first power supply voltage; and the second transistor including a gate connected to the first resistor, a first terminal connected to the first output line of the first power supply voltage, and a second terminal connected to a ground line, and wherein the second power supply voltage generation unit includes: a third transistor including a gate connected to a third power supply voltage control signal, a first terminal connected to the DC power supply voltage, and a second terminal connected to a second output line of the second power supply voltage; and the fourth transistor including a gate connected to the second resistor, a first terminal connected to the second output line of the second power supply voltage, and a second terminal connected to the ground line, and wherein the first resistor is connected between a second input line of a second power supply voltage control signal and the gate of the second transistor, and the second resistor is connected between a fourth input line of a fourth power supply voltage control signal and the gate of the fourth transistor.

The first resistor and the second resistor may be variable resistors, and the first and third transistors may be p-type transistors, and the second and fourth transistors may be n-type transistors, and wherein the first power supply voltage generation unit includes: a first detector detecting a second gate level of a second gate voltage applied to the gate of the second transistor; and a first resistor controlling unit reducing a first resistance of the first resistor when a second control signal level of the second power supply voltage control signal is changed from a low level to a high level and when the second gate level of the second gate voltage applied to the gate of the second transistor exceeds a first reference voltage level, and wherein the second power supply voltage generation unit includes: a second detector detecting a fourth gate level of a fourth gate voltage applied to the gate of the fourth transistor; and a second resistor controlling unit reducing a second resistance of the second resistor when a fourth control signal level of the fourth power supply voltage control signal is changed from a low level to a high level and when the fourth gate level of the fourth gate voltage applied to the gate of the fourth transistor exceeds a second reference voltage level.

The first reference voltage level may be a first reference voltage value at which a Miller effect occurs at the gate of the second transistor when the second power supply voltage control signal is changed from the low level to the high level, and the second reference voltage level may be a second reference voltage value at which the Miller effect occurs at the gate of the fourth transistor when the fourth power supply voltage control signal is changed from the low level to the high level.

Each of the plurality of pixels may include: a first pixel transistor including a gate connected to scan lines, a first terminal connected to data lines, and a second terminal connected to a first node; a second pixel transistor including a gate connected to a second node, a first terminal connected to the first power supply voltage, and a second terminal connected to an anode of the OLED; a third pixel transistor including a gate connected to control lines, a first terminal connected to the gate of the second pixel transistor, and a second terminal connected to the second terminal of the second pixel transistor; a first capacitor connected between the first power supply voltage and the first node; a second capacitor connected between the first node and the second node; and the OLED including the anode connected to the second terminal of the second pixel transistor and a cathode connected to the second power supply voltage, and wherein the first through third pixel transistors are p-type transistors.

The first power supply voltage may drop from a high voltage level to a low voltage level in a period in which the second pixel transistor is turned on so as to initialize an OLED voltage at the anode of the OLED. The second power supply voltage may drop from a high voltage level to a low voltage level in a period in which the second pixel transistor is turned on so that the OLED emits light.

The first power supply voltage and the second power supply voltage may be commonly supplied to the plurality of pixels.

Each of the plurality of pixels may include: a first pixel transistor including a gate connected to scan lines, a first terminal connected to data lines, and a second terminal connected to a first node; a second pixel transistor including a gate connected to a second node, a first terminal connected to a cathode of the OLED, and a second terminal connected to the second power supply voltage; a third pixel transistor including a gate connected to control lines, a first terminal connected to the first terminal of the second pixel transistor, and a second terminal connected to the gate of the second pixel transistor; a first capacitor connected between the first node and the second power supply voltage; a second capacitor connected between the first node and the second node; and the OLED including an anode connected to the first power supply voltage and a cathode connected to the first terminal of the second pixel transistor, and wherein the first through third pixel transistors are n-type transistors.

The organic light-emitting display apparatus may further include: a scan driving unit generating scan signals and supplying the scan signals to the plurality of pixels through the scan lines; a data driving unit generating data voltages and supplying the data voltages to the plurality of pixels through the data lines; a control line driving unit generating control signals for turning on the third pixel transistor in a threshold voltage compensating-for period so as to store a second capacitor voltage corresponding to a threshold voltage of the second pixel transistor in the second capacitor and supplying the control signals to the plurality of pixels through the control lines; and a timing driving unit controlling the scan driving unit, the data driving unit, the power supply voltage driving unit, and the control line driving unit.

Resistances of the first resistor and the second resistor may be determined by a sum of capacitance derived between the first power supply voltage and the second power supply voltage in the plurality of pixels.

According to another embodiment, there may be a method of driving an organic light-emitting display apparatus, the organic light-emitting display apparatus including a plurality of pixels, wherein a first level of a first power supply voltage supplied to the plurality of pixels is changed according to time, and a circuitry for generating the first power supply voltage includes a first transistor for pulling-up the first power supply voltage, a second transistor for pulling-down the first power supply voltage, and a first resistor connected to a gate of the second transistor and having a variable resistance, the method including: when a first control signal level of a first power supply voltage control signal supplied to the gate of the second transistor through the first resistor is changed so that the first power supply voltage is changed from a high voltage level to a low voltage level, detecting a second gate voltage applied to the gate of the second transistor; and if the second gate voltage applied to the gate of the second transistor exceeds a first reference voltage level, reducing a first resistance of the first resistor.

The first reference voltage level may be a first reference voltage value at which a Miller effect occurs at the gate of the second transistor when the first level of the first power supply voltage control signal is changed so that the first power supply voltage is changed from the high voltage level to the low voltage level.

A second level of a second power supply voltage supplied to the plurality of pixels may be changed according to time, and a circuitry for generating the second power supply voltage may include a third transistor for pulling-up the second power supply voltage, a fourth transistor for pulling-down the second power supply voltage, and a second resistor connected to a gate of the fourth transistor and having a variable resistance, the method further including: when a second control signal level of a second power supply voltage control signal supplied to the gate of the fourth transistor through the second resistor is changed so that the second power supply voltage is changed from a high voltage level to a low voltage level, detecting a fourth gate voltage applied to the gate of the fourth transistor; and if the fourth gate voltage applied to the gate of the fourth transistor exceeds a first reference voltage level, reducing a second resistance of the second resistor.

The first and third transistors may be p-type transistors and the second and fourth transistors may be n-type transistors.

The plurality of pixels may include a first node which is connected to the first power supply voltage through a first capacitor and to which a data voltage is applied through a first pixel transistor, and a second node connected to the first node through a second capacitor and connected to the gate of the second pixel transistor, and the second pixel transistor is connected between the first power supply voltage and an anode of an organic light-emitting diode (OLED), and the third pixel transistor is connected between the gate of the second pixel transistor and a second terminal of the second pixel transistor and thereby diode-connecting the second pixel transistor according to a control signal, and the second power supply voltage is connected to a cathode of the OLED, the method further including: a resetting operation of supplying the first and second power supply voltages having the high voltage level to the plurality of pixels and initializing a first node voltage value; an initialization operation of dropping the first power supply voltage from the high voltage level to the low voltage level, initializing an anode voltage value of the OLED to the low voltage level and then rising the first power supply voltage to the high voltage level; a threshold voltage compensating-for operation of diode-connecting the second pixel transistor by turning on the third pixel transistor and storing a second capacitor voltage value corresponding to a threshold voltage of the second pixel transistor in the second capacitor; a scanning/data inputting operation of sequentially turning on the first pixel transistor of the plurality of pixels to store the data voltage in the first capacitor of the plurality of pixels; and an emission operation of allowing the OLED to emit light by dropping the second power supply voltage to the low voltage level.

The first through third pixel transistors may be p-type transistors. The method may further include, after the emission operation of allowing the OLED to emit light, a non-emitting operation of turning off the OLED by rising the second power supply voltage up to the high voltage level.

The first power supply voltage and the second power supply voltage may be commonly supplied to the plurality of pixels.

Resistances of the first resistor and the second resistor may be determined by a sum of capacitance derived between the first power supply voltage and the second power supply voltage in the plurality of pixels.

BRIEF DESCRIPTION OF THE DRAWINGS

The above and other features will become more apparent by describing in detail exemplary embodiments with reference to the attached drawings in which.

DETAILED DESCRIPTION OF THE INVENTION

Example embodiments will now be described more fully hereinafter with reference to the accompanying drawings; however, they may be embodied in different forms and should not be construed as limited to the embodiments set forth herein.

Present embodiments will now be described more fully with reference to the accompanying drawings in which exemplary embodiments are shown.

Figure 1:
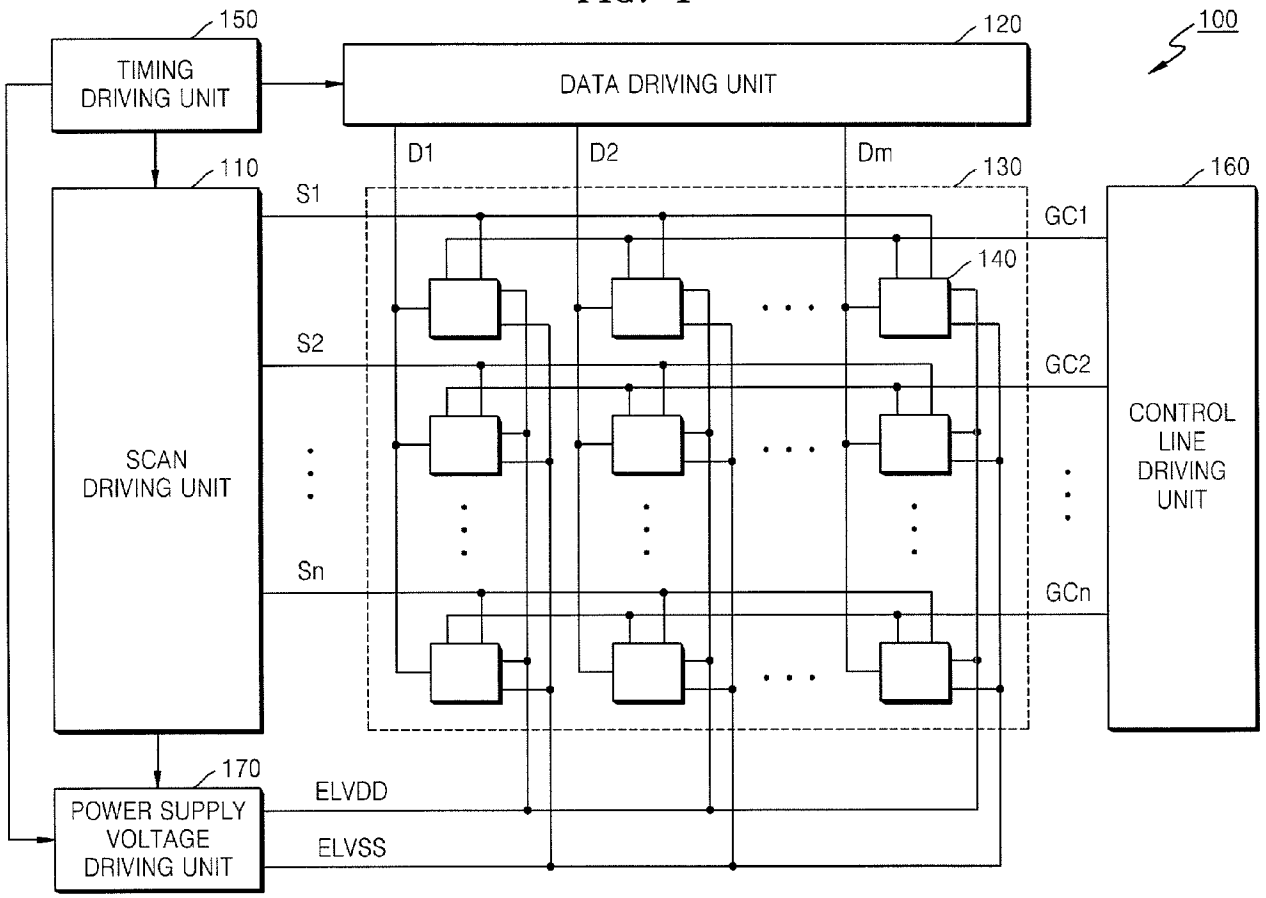
FIG. 1 is a block diagram of an organic light-emitting display apparatus, according to an embodiment.

FIG. 1 is a block diagram of an organic light-emitting display apparatus 100 according to an embodiment.

Referring to FIG. 1, the organic light-emitting display apparatus 100 according to the present embodiment includes a pixel unit 130 including scan lines S1 through Sn, control lines GC1 through GCn, data lines D1 through Dm, and pixels 140 connected to first and second power supply lines ELVDD and ELVSS, a scan driving unit 110 that supplies each of scan signals to each pixel 140 through each of the scan lines S1 through Sn, a control line driving unit 160 that supplies each of control signals to each pixel 140 through each of the control lines GC1 through GCn, a data driving unit 120 that provides each of data voltages to each pixel 140 through each of the data lines D1 through Dm, and a timing controller 150 that controls the scan driving unit 110, the data driving unit 120, and the control line driving unit 160. The organic light-emitting display apparatus 100 according to the present embodiment further includes a power supply voltage driving unit 170 that provides a first power supply voltage ELVDD(t) (see FIG. 2) to each pixel 140 through the first power supply line ELVDD and provides a second power supply voltage ELVSS(t) (see FIG. 2) to each pixel 140 through the second power supply line ELVSS.

The pixel unit 130 includes the pixels 140 disposed near the intersections of the scan lines 51 through Sn and the data lines D1 through Dm. The pixel 140 to which a data voltage is to be applied controls the amount of current supplied to the second power supply line ELVSS via an organic light-emitting diode (OLED) from the first power supply line ELVDD. Then, light with a predetermined luminance is generated by the OLED.

In the present embodiment, at least one of the first power supply voltage ELVDD(t) and the second power supply voltage ELVSS(t) is applied to each pixel 140 of the pixel unit 130 as voltage values changed for a frame period.

Control signals for driving the first and second power supply voltages ELVDD(t) and ELVSS(t) may be input to the power supply voltage driving unit 170. The control signals input to the power supply voltage driving unit 170 may be generated by the timing controller 150 or the scan driving unit 110 and may be input to the power supply voltage driving unit 170.

To this end, the power supply voltage driving unit 170 is controlled by the timing controller 150 and generates the first power supply voltage ELVDD(t) and the second power supply voltage ELVSS(t). The first power supply voltage ELVDD (t) and the second power supply voltage ELVSS(t) may be driven by using three methods.

In the first method, the first power supply voltage ELVDD (t) is applied to each pixel 140 as voltage values having three different levels, and the second power supply voltage ELVSS (t) is applied to each pixel 140 as a fixed low level, e.g., a ground voltage GND.

In this case, since the power supply voltage driving unit 170 outputs a voltage value having a predetermined level, e.g., the ground voltage GND, as the second power supply voltage ELVSS(t), a circuit terminal for driving the second power supply voltage ELVSS(t) does not need to be provided, and costs may be reduced. Since the first power supply voltage ELVDD(t) requires a negative voltage value, e.g., −3 V, from among three voltage levels, the configuration of a circuit for generating the first power supply voltage ELVDD(t) may be complicated.

In the second method, both the first power supply voltage ELVDD(t) and the second power supply voltage ELVSS(t) are applied to each pixel 140 as voltage values having two voltage levels. In this case, the power supply voltage driving unit 170 includes circuit terminals for driving the first power supply voltage ELVDD(t) and the second power supply voltage ELVSS(t), respectively.

The third method is performed opposite to the first method. In the third method, the first power supply voltage ELVDD(t) is applied to each pixel 140 as a voltage value having a fixed high level, and the second power supply voltage ELVSS(t) is applied to each pixel 140 as voltage values having three different levels.

In this case, since the power supply voltage driving unit 170 outputs a voltage value having a predetermined level as the first power supply voltage ELVDD(t), an additional circuit terminal for driving the first power supply voltage ELVDD(t) does not need to be provided, and costs may be reduced. Since the second power supply voltage ELVSS(t) requires a positive voltage value from among three voltage levels, the configuration of a circuit terminal for driving the second power supply voltage ELVSS(t) may be complicated.

Also, embodiments may be applied to various methods of driving the organic light-emitting display apparatus 100 whereby the first power supply voltage ELVDD(t) and the second power supply voltage ELVSS(t) vary according to time.

Figure 2:
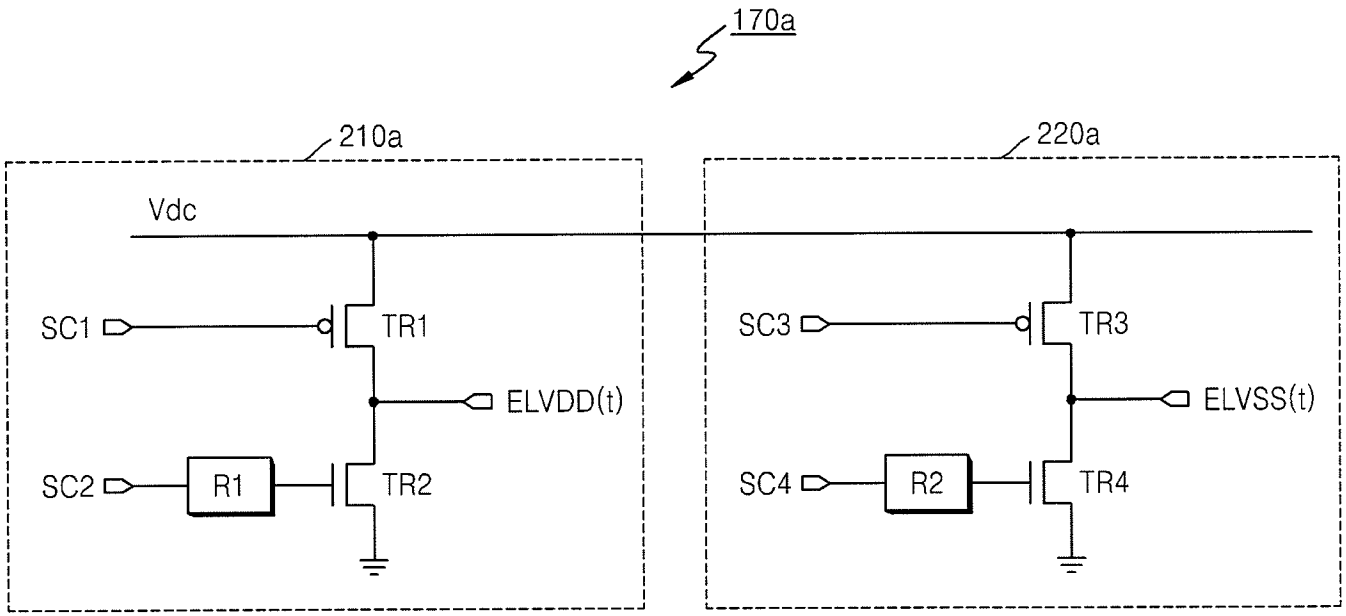
FIG. 2 is a block diagram of a structure of a power supply voltage driving unit according to an embodiment.

FIG. 2 is a block diagram of a structure of a power supply voltage driving unit 170*a* according to an embodiment.

First through fourth power supply voltage control signals SC1, SC2, SC3, and SC4 are input to the power supply voltage driving unit 170*a*, and the power supply voltage driving unit 170*a* generates and outputs the first power supply voltage ELVDD(t) and the second power supply voltage ELVSS(t). The power supply voltage driving unit 170*a* includes a first power supply voltage generation unit 210*b* and a second power supply voltage generation unit 220*a*.

The first and second power supply voltage control signals SC1 and SC2 are input to the first power supply voltage generation unit 210*a*, and the first power supply voltage generation unit 210*a* generates the first power supply voltage ELVDD(t). The first power supply voltage generation unit 210*a* includes a first transistor TR1, a second transistor TR2, and a first resistor R1 connected to a gate of the second transistor TR2. The first resistor R1 is connected between an input line of the second power supply voltage control signal SC2 and the gate of the second transistor TR2. The first resistor R1 may be a fixed or variable resistor. The first transistor TR1 may be a p-type transistor, and the second transistor TR2 may be an n-type transistor. The first transistor TR1 includes a gate to which the first power supply voltage control signal SC1 is input, a first terminal connected to a direct current (DC) power supply voltage Vdc, and a second terminal connected to an output line of the first power supply voltage ELVDD(t). The second transistor TR2 includes a gate connected to the first resistor R1, a first terminal connected to the output line of the first power supply voltage ELVDD(t), and a second terminal connected to a ground line.

The third and fourth power supply voltage control signals SC3 and SC4 are input to the second power supply voltage generation unit 220*a*, and the second power supply voltage generation unit 220*a* generates the second power supply voltage ELVSS(t). The second power supply voltage generation unit 220*a* includes a third transistor TR3, a fourth transistor TR4, and a second resistor R2 connected to a gate of the fourth transistor TR4. The second resistor R2 is connected to an input line of the fourth power supply voltage control signal SC4 and the gate of the fourth transistor TR4. The second resistor R2 may be a fixed or variable resistor. The third transistor TR3 may be a p-type transistor, and the fourth transistor TR4 may be an n-type transistor. The third transistor TR3 includes a gate to which the third power supply voltage control signal SC3 is input, a first terminal connected to the DC power supply voltage Vdc, and a second terminal connected to an output line of the second power supply voltage ELVSS(t).

A resistance of the first resistor R1 may be determined by the sum of capacitances of the pixels 140 presented on the output line of the first power supply voltage ELVDD(t), and a resistance of the second resistor R2 may be determined by the sum of capacitances of the pixels 140 presented on the output line of the second power supply voltage ELVSS(t). As the sum of capacitances of the pixels 140 increases, the resistances of the first and second resistors R1 and R2 increase, and as the sum of capacitances of the pixels 140 decreases, the resistances of the first and second resistors R1 and R2 decrease.

Figure 3:
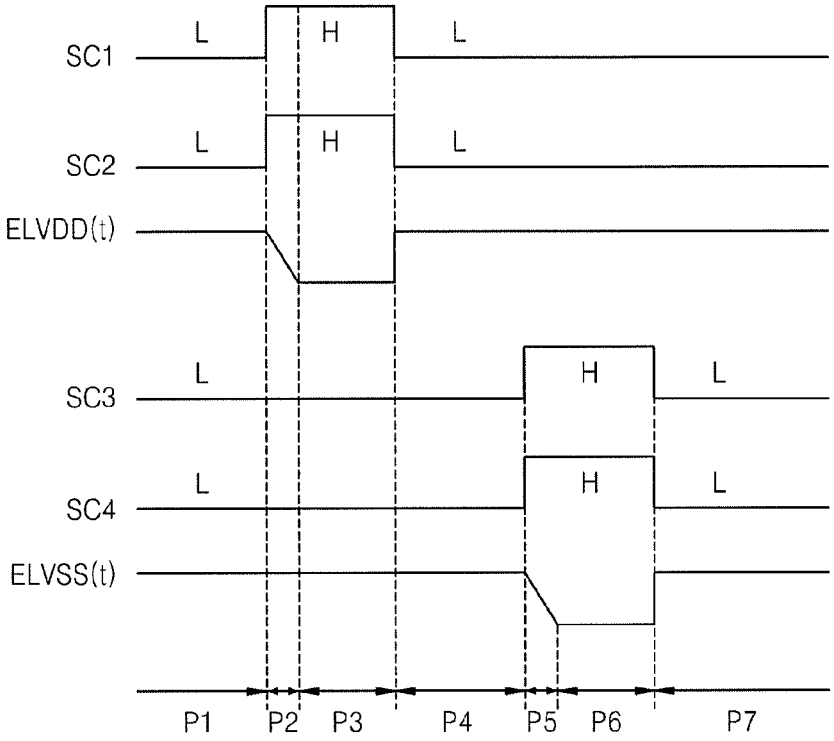
FIG. 3 is a timing diagram showing an operation of the power supply voltage driving unit illustrated in FIG. 2.

FIG. 3 is a timing diagram showing an operation of the power supply voltage driving unit 170*a* of FIG. 2.

The organic light-emitting display apparatus 100 may use a method of driving the organic light-emitting display apparatus 100 whereby voltage values of the first power supply voltage ELVDD(t) and the second power supply voltage ELVSS(t) vary according to time, as illustrated in FIG. 3. In FIG. 3, the first power supply voltage ELVDD(t) is changed during periods P2 and P3, and the second power supply voltage ELVSS(t) is changed during periods P5 and P6.

During the period P1, each of the first power supply voltage ELVDD(t) and the second power supply voltage ELVSS(t) has a high voltage level, i.e., a level of the DC power supply voltage Vdc. During the period P1, the first and third power supply voltage control signals SC1 and SC3 both have a low level L so that the first and third transistors TR1 and TR3 are turned on, and the second and fourth power supply voltage control signals SC2 and SC4 both have a low level L so that the second and fourth transistors TR2 and TR4 are turned off. Thus, during the period P1, a current path is formed between the output line of the first power supply voltage ELVDD(t) and the DC power supply voltage Vdc so that the first power supply voltage ELVDD(t) with a high voltage level is output, and a current path is formed between the output line of the second power supply voltage ELVSS(t) and the DC power supply voltage Vdc so that the second power supply voltage ELVSS(t) with a high voltage level is output.

When the period P2 is about to start, in order to the level of the first power supply voltage ELVDD(t) to drop to a low voltage level, i.e., a ground voltage level, the first and second power supply voltage control signals SC1 and SC2 are changed to have a high level H. In the present embodiment, the first resistor R1 is disposed between an input line of the second power supply voltage control signal SC2 and the gate of the second transistor TR2 so that, when the level of the first power supply voltage ELVDD(t) is dropping to the low voltage level, the level of the first power supply voltage ELVDD (t) gradually drops with a predetermined slope. In other words, according to an embodiment, when the level of the second power supply voltage control signal SC2 is changed from the low level L to the high level H, the second power supply voltage control signal SC2 is applied to the gate of the second transistor TR2 through the first resistor R1. Thus, the speed of a change in control signal levels at the gate of the second transistor TR2 is decreased, and thus, the speed of a change in the first power supply voltage ELVDD(t) is also decreased. Thus, according to an embodiment, when the period P2 is about to start, voltage levels of the first and second power supply voltage control signals SC1 and SC2 are changed from the low level L to the high level H, during the period P2, the level of the first power supply voltage ELVDD (t) is gradually changed from a high voltage level to a low voltage level and is maintained at the low voltage level in the period P3.

When the period P4 is about to start, the first and second power supply voltage control signals SC1 and SC2 are changed from the high level H to the low level L. Thus, during the period P4, similarly to the period P1, both of the first power supply voltage ELVDD(t) and the second power supply voltage ELVSS(t) have a high voltage level.

When the period P5 is about to start, in order for the level of the second power supply voltage ELVSS(t) to drop to a low voltage level, voltage levels of the third and fourth power supply voltage control signals SC3 and SC4 are changed into the high level H. In the present embodiment, the second resistor R2 is disposed between the input line of the fourth power supply voltage control signal SC4 and the gate of the fourth transistor TR4 so that the level of the second power supply voltage ELVSS(t) gradually drops from a high voltage level into a low voltage level with a predetermined slope. In other words, according to the present embodiment, when the level of the fourth power supply voltage control signal SC4 is changed from the low level L to the high level H, the fourth power supply voltage control signal SC4 is applied to the gate of the fourth transistor TR4 through the second resistor R2, the speed of a change in the control signal level at the gate of the fourth transistor TR4 is decreased, and thus, the speed of a change in the second power supply voltage ELVSS(t) is also decreased. Thus, according to an embodiment, when the period P5 is about to start and levels of the third and fourth power supply voltage control signals SC3 and SC4 are changed from the low level L to the high level H, during the period P5, the level of the second power supply voltage ELVSS(t) is gradually changed from the high voltage level to the low voltage level and is maintained at the low voltage level during the period P6.

When the period P7 is about to start, the levels of the third and fourth power supply voltage control signals SC3 and SC4 are changed from the high level H to the low level L. Thus, during the period P7, similarly to the period P1, both of the first power supply voltage ELVDD(t) and the second power supply voltage ELVSS(t) have a high voltage level.

Figure 4:
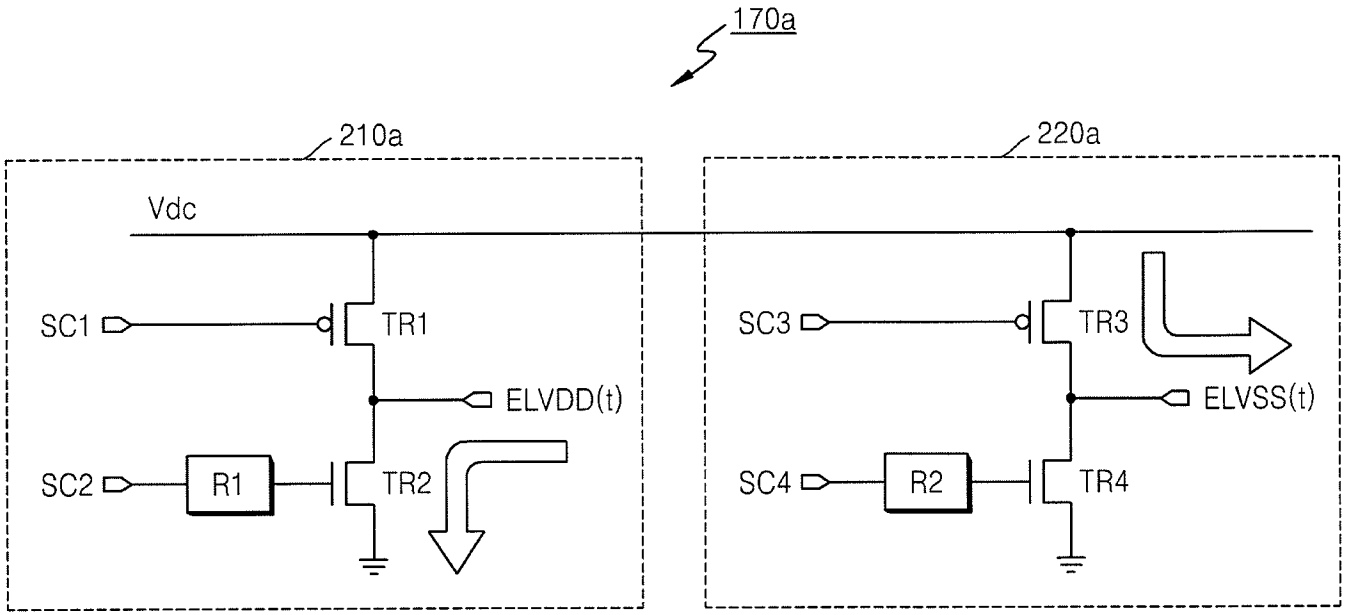
FIGS. 4 and 5 are block diagrams of the power supply voltage driving unit 170*a* of FIG. 2 to explain the effects of present embodiments.
Figure 5:
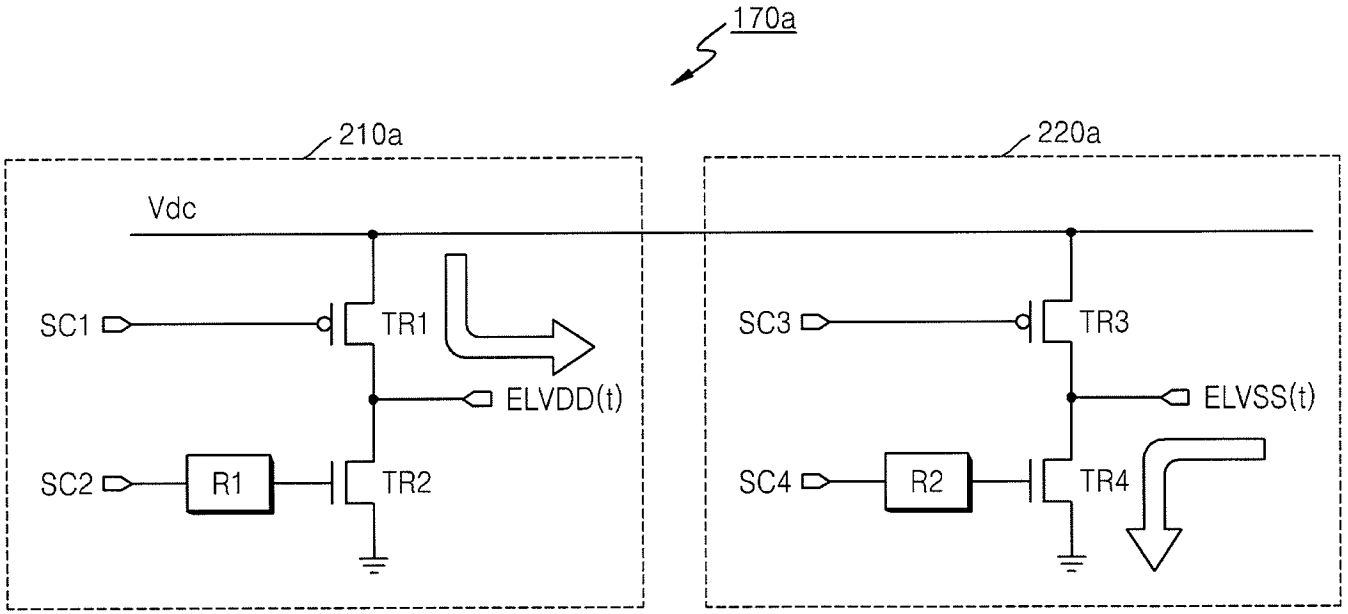

FIGS. 4 and 5 are block diagrams of the power supply voltage driving unit 170*a* of FIG. 2 to explain the effects of present embodiments.

According to embodiments, the organic light-emitting display apparatus 100 of FIG. 1 has the above-described structure so that a surge current generated when the first or second power supply voltage ELVDD(t) or ELVSS(t) is dropping may be reduced. Similar to FIG. 4, when the level of the first power supply voltage ELVDD(t) is dropping, the first transistor TR1 is turned off and the second transistor TR2 is turned on so that current flows through a ground line from the output line of the first power supply voltage ELVDD(t). However, as the first power supply voltage ELVDD(t) is decreased, charges are discharged from capacitance in the pixels 140 of the pixel unit 130, for example, capacitance of an OLED, through the first power supply line ELVDD so that current flows to the capacitance in the pixels 140 from the second power supply line ELVSS so as to charge the capacitance in the pixels 140. Thus, as illustrated in FIG. 4, current flows from the output line of the second power supply voltage ELVSS(t) from the DC power supply voltage Vdc through the third transistor TR3. However, since the sum of the capacitance in each pixel 140 is very large, when the first power supply voltage ELVDD(t) is dropping, a surge current is generated and flows from the DC power supply voltage Vdc to the output line of the second power supply voltage ELVSS(t).

Contrary to this, as illustrated in FIG. 5, when the second power supply voltage ELVSS(t) is dropping, charges are discharged from the capacitance in the pixels 140 through the second power supply line ELVSS, and in order to charge the capacitance in the pixels 140, current flows to the capacitance in the pixels 140 from the first power supply line ELVDD. Thus, as illustrated in FIG. 5, a surge current flows from the output line of the first power supply voltage ELVDD(t) through the first transistor TR1.

Since the surge current is several tens of amperes (A), a power supply for supplying the DC power supply voltage Vdc may be burdened. Thus, the life span of elements of the pixel unit 130 may be reduced, or the elements of the pixel unit 130 may be destroyed.

According to an embodiment, as described above, when the level of the first or second power supply voltage ELVDD (t) or ELVSS(t) drops, the speed of a change in the levels of the first and second power supply voltages ELVDD(t) and ELVSS(t) is decreased so that current of the output line of the second or first power supply voltage ELVSS(t) or ELVDD(t) is maintained at a load current level and a surge current is prevented from being generated in the organic light-emitting display apparatus 100. Thus, a power supply for supplying the DC power supply voltage Vdc may be protected, and elements of the pixel unit 130 may also be protected. In particular, characteristics of the OLED may be prevented from deteriorating, and the degradation of an image quality due to damage to the OLED may be prevented. Furthermore, the increase to the specification of components due to the surge current may be prevented, and the cost for manufacturing the organic light-emitting display apparatus 100 may be reduced.

Figure 6:
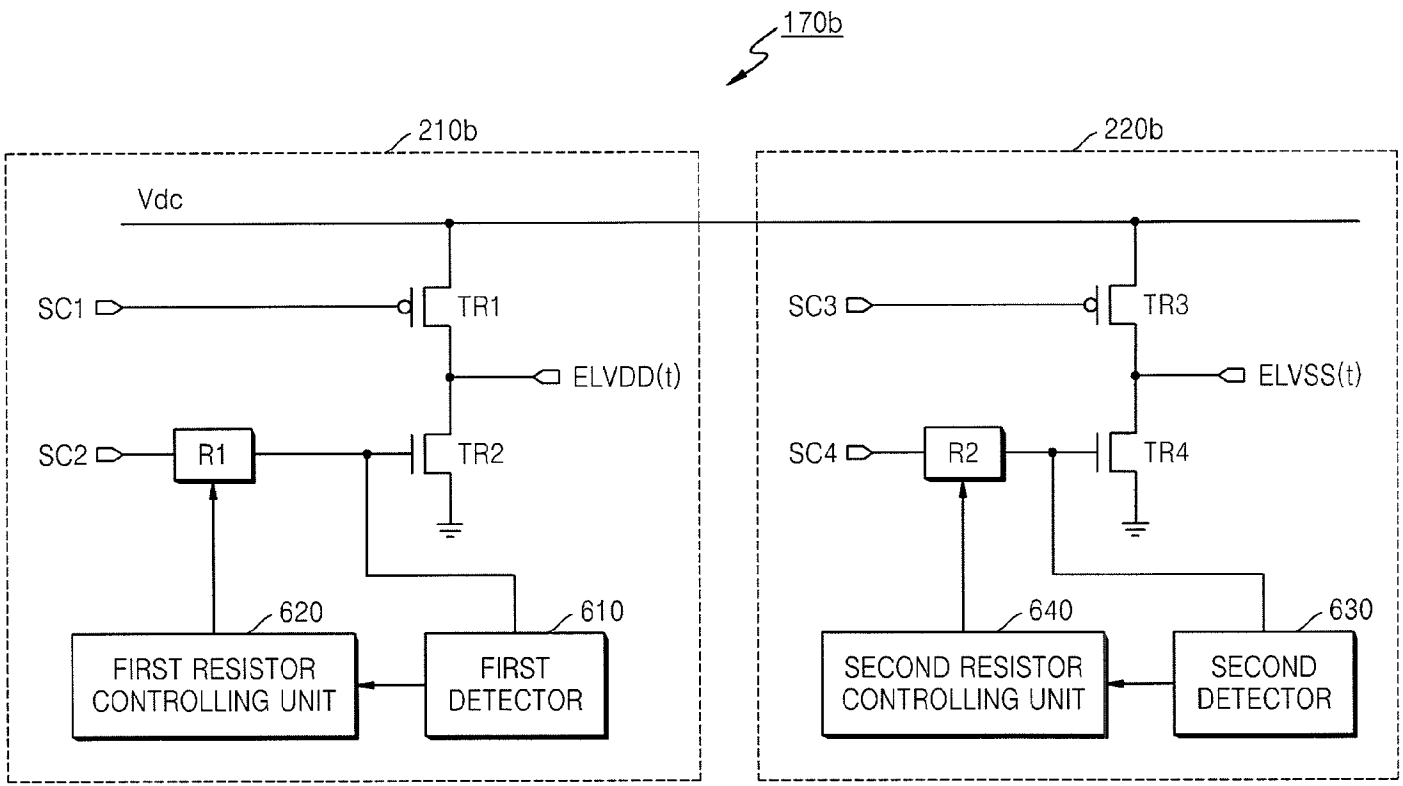
FIG. 6 is a block diagram of a structure of a power supply voltage driving unit according to another embodiment.

FIG. 6 is a block diagram of a structure of a power supply voltage driving unit 170*b* according to another embodiment. Hereinafter, the difference between FIGS. 6 and 2 will be described with reference to FIG. 6, and the structure and operation of the power supply voltage driving unit 170*b* illustrated in FIG. 6 will also be described.

The power supply voltage driving unit 170*b* illustrated in FIG. 6 detects voltage levels of gates of second and fourth transistors TR2 and TR4, thereby adjusting the resistances of the first and second resistors R1 and R2. The power supply voltage driving unit 170*b* of FIG. 6 includes a first power supply voltage generation unit 210*b* and a second power supply voltage generation unit 220*b*.

The first and second power supply voltage control signals SC1 and SC2 are input to the first power supply voltage generation unit 210*b*, and the first power supply voltage generation unit 210*b* generates the first power supply voltage ELVDD(t). The first power supply voltage generation unit 210*b* includes a first transistor TR1, the second transistor TR2, a first resistor R1 connected to the gate of the second transistor TR2, a first detector 610, and a first resistor controlling unit 620.

The first resistor R1 is a variable resistor having a resistance that changes according to a control signal. The resistance of the first resistor R1 is changed according to a first resistor control signal supplied by the first resistor controlling unit 620.

The first detector 610 detects a level of a voltage applied to the gate of the second transistor TR2 and provides the detected level of the voltage applied to the gate of the second transistor TR2 to the first resistor controlling unit 620. The first resistor controlling unit 620 controls a resistance of the first resistor R1 according to the level of the voltage applied to the gate of the second transistor TR2. The first resistor controlling unit 620 maintains a high resistance of the first resistor R1 before the Miller effect occurs at the gate of the second transistor TR2, and when the Miller effect occurs, the resistance of the first resistor R1 may be reduced. To this end, the first resistor controlling unit 620 may adjust the resistance of the first resistor R1 from a first resistance to a second resistance when the level of the voltage applied to the gate of the second transistor TR2 exceeds a first reference voltage level Vref1. In this regard, the first resistance is greater than the second resistance.

The third and fourth power supply voltage control signals SC3 and SC4 are input to the second power supply voltage generation unit 220*b*, and the second power supply voltage generation unit 220*b* generates the second power supply voltage ELVSS(t). The second power supply voltage generation unit 220*a* includes a third transistor TR3, the fourth transistor TR4, a second resistor R2 connected to the gate of the fourth transistor TR4, a second detector 630, and a second resistor controlling unit 640.

The second resistor R2 is a variable resistor having a resistance that changes according to a control signal. The resistance of the second resistor R2 is changed according to a second resistor controlling signal supplied by the second resistor controlling unit 640.

The second detector 630 detects a level of a voltage applied to the gate of the fourth transistor TR4 and provides the detected level of the voltage applied to the gate of the fourth transistor TR4 to the second resistor controlling unit 640. The second resistor controlling unit 640 controls the resistance of the second resistor R2 according to the level of the voltage applied to the gate of the fourth transistor TR4. The second resistor controlling unit 640 maintains a high resistance of the second resistor R2 before the Miller effect occurs at the gate of the fourth transistor TR4, and when the Miller effect occurs, the resistance of the second resistor R2 may be reduced. To this end, the second resistor controlling unit 640 may adjust the resistance of the second resistor R2 from a third resistance to a fourth resistance when the level of the voltage applied to the gate of the second transistor TR2 exceeds a second reference voltage level Vref2. In this regard, the third resistance is greater than the fourth resistance. The third resistance may be the same as the first resistance, and the fourth resistance may be the same as the second resistance.

In the present specification, an embodiment in which the third resistance is the same as the first resistance and the fourth resistance is the same as the second resistance, is described below. In addition, an embodiment in which the first reference voltage level Vref1 and the second reference voltage level Vref2 are the same as each other, is described below. However, the scope of present embodiments are not limited thereto.

Figure 7:
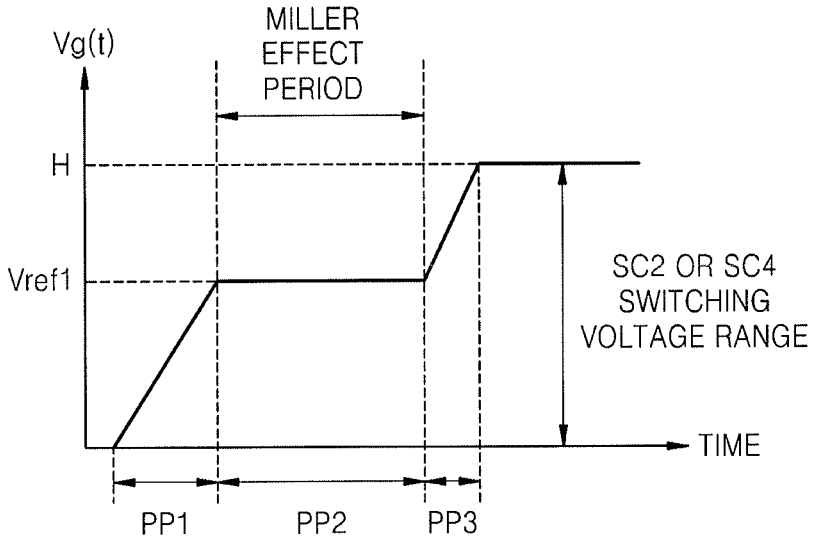
FIG. 7 is a graph showing a change in a level of a voltage applied to a gate of a second or fourth transistor due to the Miller effect.

FIG. 7 is a graph showing a change in the level of the voltage applied to the gate of the second or fourth transistor TR2 or TR4 due to the Miller effect.

When the second or fourth power supply voltage control signal SC2 or SC4 is changed from the low level L to the high level H, voltages applied to the gates of the second and fourth transistors TR2 and TR4 (hereinafter, referred to as 'Vg(t)') are changed, as illustrated in FIG. 7. The period P2 or P5 may include periods PP1, PP2, and PP3. When the second or fourth power supply voltage control signal SC2 or SC4 is changed from the low level L to the high level H, Vg(t) is gradually increased from the low level L to the first reference voltage level Vref1 during the period PP1. However, when Vg(t) reaches the first reference voltage level Vref1, due to the Miller effect, Vg(t) is hardly increased during the period PP2, and after a predetermined time has elapsed, Vg(t) is gradually increased from the first reference voltage level Vref1 to the high level H during the period PP3. When Vg(t) reaches the first reference voltage level Vref1 and a period in which the Miller effect occurs has elapsed, a current that flows through the second or fourth transistor TR2 or TR4 is hardly related to Vg(t). Thus, according to another embodiment, when the Miller effect period has elapsed, i.e., when the period PP2 has elapsed and the period PP3 is about to start, a resistance of the first or second resistor R1 or R2 is reduced. Whether the period PP2 has elapsed may be recognized by detecting that Vg(t) exceeds the first reference voltage level Vref1.

Figure 8:
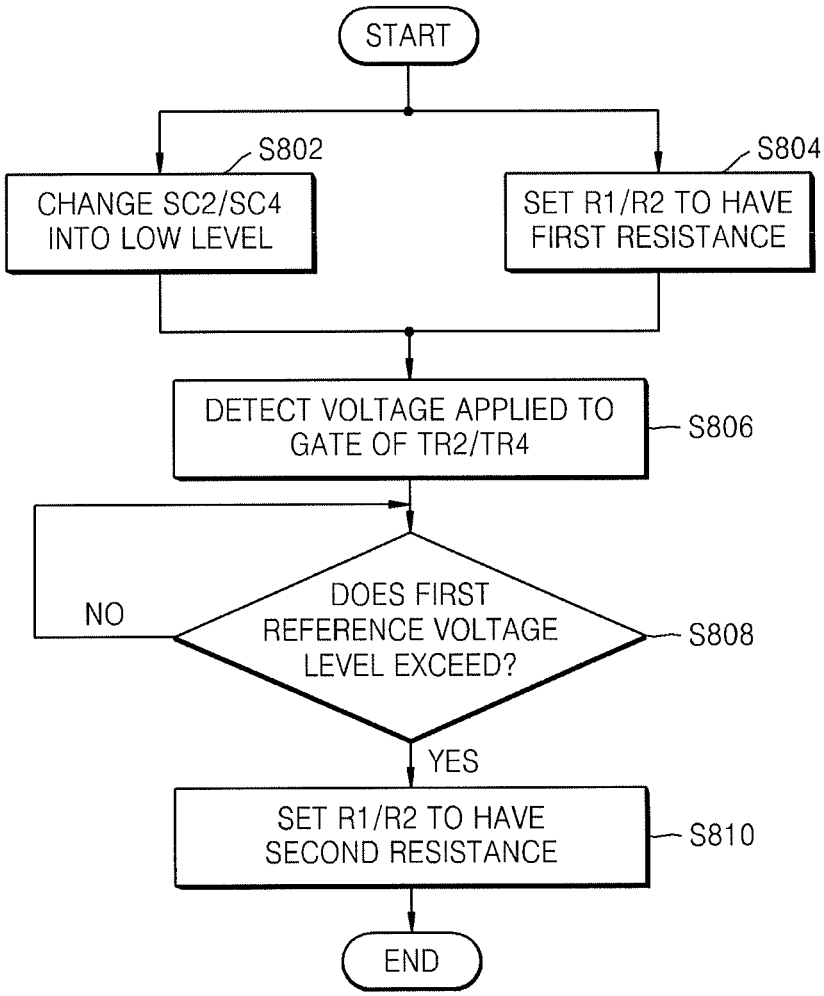
FIG. 8 is a flowchart illustrating a method of driving an organic light-emitting display apparatus, according to an embodiment.

FIG. 8 is a flowchart illustrating a method of driving an organic light-emitting display apparatus, according to an embodiment.

First, in order to change the level of the first or second power supply voltage ELVDD(t) or ELVSS(t) from the high voltage level to the low voltage level, the first or third power supply voltage control signal SC1 or SC3 and the second or fourth power supply voltage control signal SC2 or SC4 is changed from the low level L to the high level H in operation S802, and the first or second resistor R1 or R2 is set to have the first resistance in operation 5804. After the level of the second or fourth power supply voltage control signal SC2 or SC4 is changed into the high level H, Vg(t) is subsequently detected in operation S806. After Vg(t) reaches the first reference voltage level Vref1 and exceeds the first reference voltage level Vref1 in operation 5808, the first or second resistor R1 or R2 is set to have the second resistance in operation S810.

Figure 9:
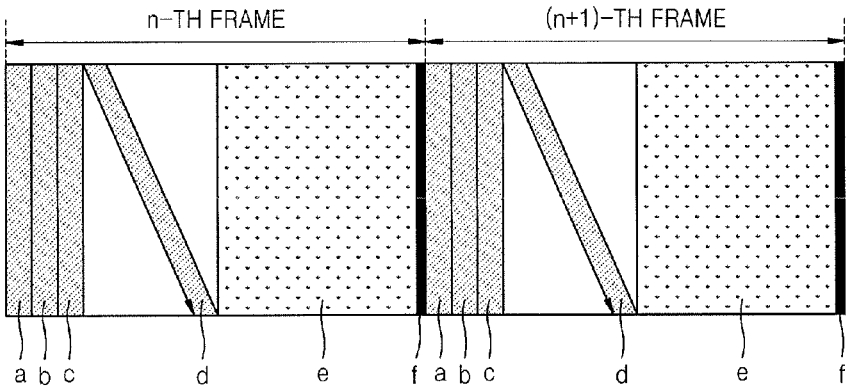
FIG. 9 is a diagram illustrating a method of driving an organic light-emitting display apparatus, according to another embodiment.

FIG. 9 is a diagram illustrating a method of driving an organic light-emitting display apparatus, according to another embodiment.

In the present embodiment, FIG. 8 may be applied to an organic light-emitting display apparatus of a simultaneous emission type. In the simultaneous emission type apparatus, pieces of data are sequentially input to an organic light-emitting display apparatus during a period of one frame, and after the data is input completely, the whole pixel unit 130, i.e., all pixels 140 in the pixel unit 130, emits light all together at the same time.

In more detail, referring to FIG. 9, the method of driving an organic light-emitting display apparatus includes: (a) performing initialization; (b) resetting; (c) compensating for a threshold voltage; (d) scanning/data inputting; (e) emitting; and (f) non-emitting. The operation (d) scanning/data inputting is sequentially performed for each scan line. However, the other operations, namely, (a) performing initialization, (b) resetting, (c) compensating for a threshold voltage, (e) emitting, and (f) non-emitting, are performed by the whole pixel unit 130 all together at the same time, as illustrated in FIG. 9.

In this regard, the operation (a) performing initialization relates to a period in which each node voltage of a pixel circuit disposed in each pixel 140 is initialized to be the same as a threshold voltage input to a driving transistor, and the operation (b) resetting is an operation in which a data voltage applied to each pixel 140 of the pixel unit 130 is reset and relates to a period in which a voltage applied to an anode of the OLED drops to be less than a voltage applied to a cathode of the OLED so that the OLED may not emit.

In addition, the operation (c) compensating for a threshold voltage relates to a period in which the threshold voltage input to the driving transistor included in each pixel 140, and the operation (f) non-emitting relates to a period in which the pixel 140 is turned off for black insertion or dimming after each pixel 140 emits.

Thus, signals applied to the operations (a) performing initialization, (b) resetting, (c) compensating for a threshold voltage, (e) emitting, and (f) non-emitting, i.e., scan signals applied to scan lines S1 through Sn, the first power supply voltage ELVDD(t) and/or the second power supply voltage ELVSS(t) applied to each pixel 140, and control signals applied to control lines GC1 through GCn, are applied to each pixel 140 of the pixel unit 130 at a predetermined voltage level all together at the same time.

In the method of driving an organic light-emitting display apparatus of the simultaneous emission type illustrated in FIG. 9, the operations (a) through (f) are clearly separate from one another according to time. Thus, the number of transistors of a compensation circuit disposed in each pixel 140 and the number of signal lines for controlling the transistors may be reduced, and a shutter glass type 3D display may be easily realized.

In the shutter glass type 3D display, when a user sees a screen with shutter glasses having transmission for left eye/right eye switchable between 0% and 100%, a screen displayed by the pixel unit 130 of an image display apparatus, i.e., the organic light-emitting display apparatus 100, is output as a left-eye image and a right-eye image for each frame such that the user sees the left-eye image only with the left eye and the right-eye image only with the right eye and a stereoscopic image is realized.

Figure 10:
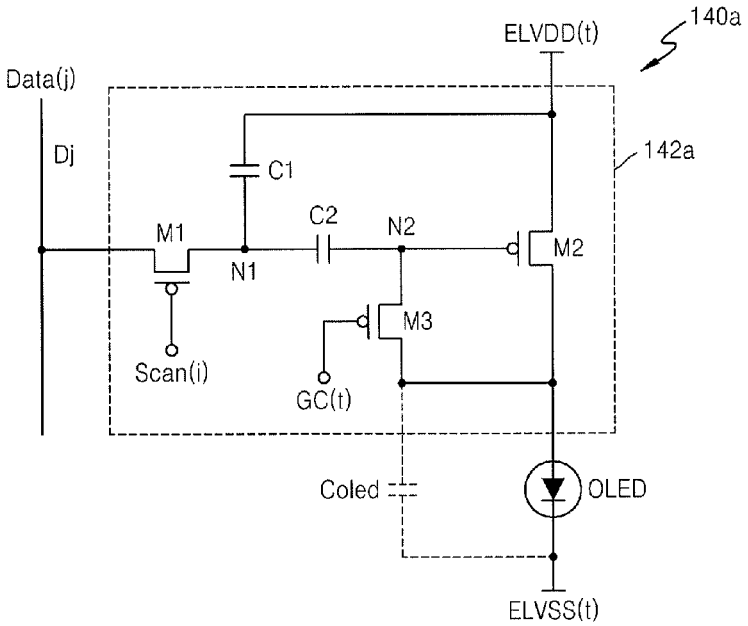
FIG. 10 is a circuit diagram of a structure of a pixel of the organic light-emitting display apparatus illustrated in FIG. 1, according to an embodiment.
Figure 11A:
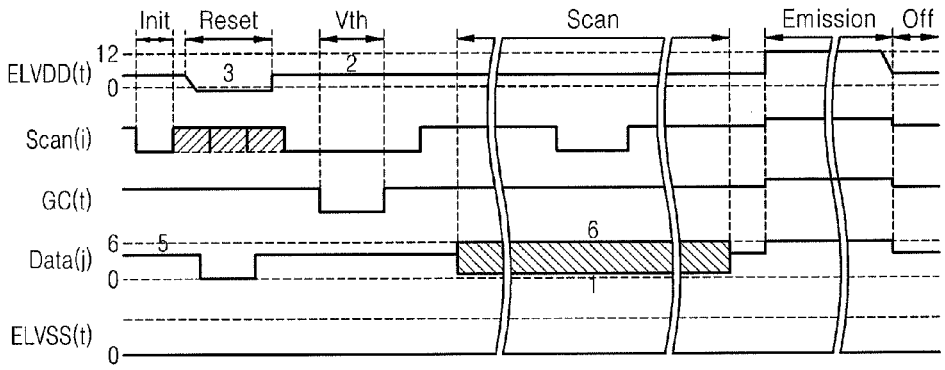
FIGS. 11A through 11C are driving timing diagrams of the pixel illustrated in FIG. 10.
Figure 11B:
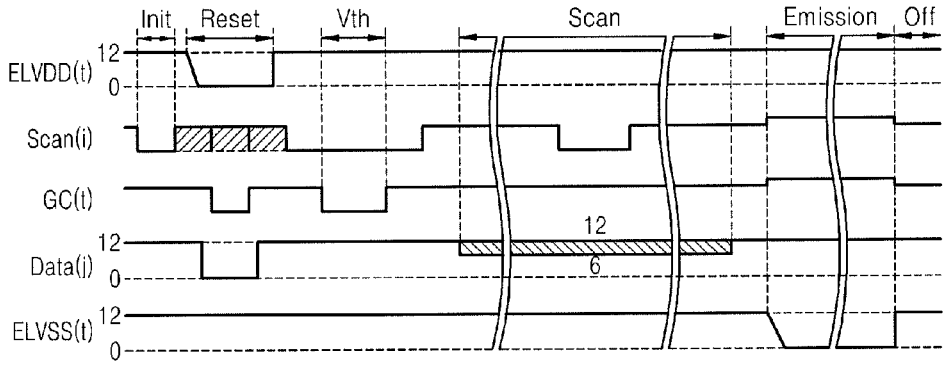
Figure 11C:
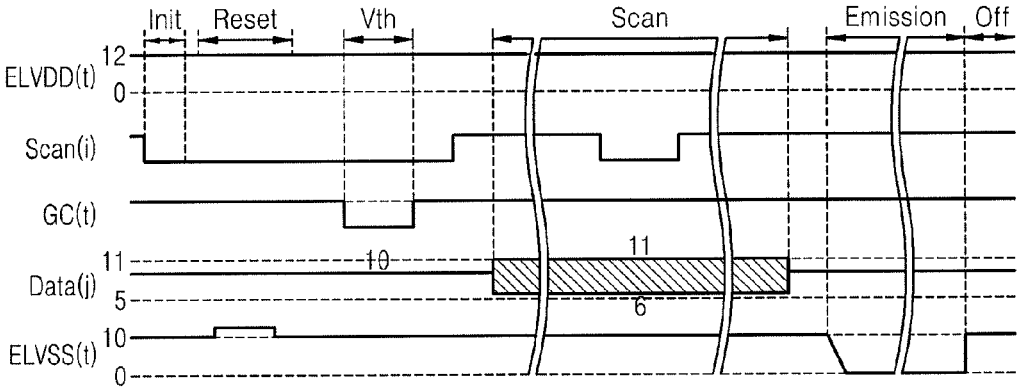

FIG. 10 is a circuit diagram of a structure of a pixel 140*a* of the organic light-emitting display apparatus 100 illustrated in FIG. 1, according to an embodiment, and FIGS. 11A through 11C are driving timing diagrams of the pixel 140*a* illustrated in FIG. 10.

Referring to FIG. 10, the pixel 140*a* according to the present embodiment includes an OLED and a pixel circuit 142*a* for supplying a current to the OLED.

An anode of the OLED is connected to the pixel circuit 142*a*, and a cathode of the OLED is connected to the second power supply voltage ELVSS(t). The OLED generates light with a predetermined luminance in correspondence with the current supplied by the pixel circuit 142*a*.

In the present embodiment, when scan signals are sequentially supplied to the scan lines S1 through Sn in a partial period of one frame (operation (d) described above), a data voltage corresponding to pieces of input data supplied to data lines D1 through Dm is applied to each pixel 140*a* that constitutes the pixel unit 130. However, in the other periods (a), (b), (c), (e), and (f) of one frame, the scan signals applied to the scan lines 51 through Sn, the first power supply voltage ELVDD(t) applied to each pixel 140, the second power supply voltage ELVSS(t), and the control signals applied to control lines GC1 through GCn are applied to each pixel 140 all together at the same time at a predetermined voltage level.

Thus, the pixel circuit 142*a* of each pixel 140 includes first through third pixel transistors M1 through M3 and two capacitors, namely, first and second capacitors C1 and C2.

In addition, in the present embodiment, a coupling effect due to the second capacitor C2 and a parasitic capacitor Coled is used in consideration of the capacitance of the parasitic capacitor Coled generated by the anode and the cathode of the OLED. This will be described with reference to FIGS. 12A through 12J in more detail.

A gate of the first pixel transistor M1 is connected to a scan line Si, and a first terminal of the first pixel transistor M1 is connected to a data line Dj via which a data voltage Data(j) is input to the first terminal of the first pixel transistor M1. A second terminal of the first pixel transistor M1 is connected to a first node N1. Si is a scan line in an i-th row, and Scan(i) is a scan signal in the i-th row, and Dj is a data line in a j-th row, and Data(j) is a data voltage in the j-th row.

A gate of the second pixel transistor M2 is connected to a second node N2, and a first terminal of the second pixel transistor M2 is connected to the first power supply voltage ELVDD(t), and a second terminal of the second pixel transistor M2 is connected to the anode of the OLED. In this regard, the second pixel transistor M2 acts as a driving transistor.

The first capacitor C1 is connected between the first node N1 and the first terminal of the second pixel transistor M2, i.e., the first power supply voltage ELVDD(t), and the second capacitor C2 is connected between the first node N1 and the second node N2.

A gate of the third pixel transistor M3 is connected to a control line GCi, and a control signal GC(t) is input to the gate of the third pixel transistor M3, and a first terminal of the third pixel transistor M3 is connected to the gate of the second pixel transistor M2, and a second terminal of the third pixel transistor M3 is connected to the anode of the OLED, i.e., the second terminal of the second pixel transistor M2. When the third pixel transistor M3 is turned on by the control signal GC(t), the second pixel transistor M2 is diode-connected. In this specification, GCi is a control line in an i-th row, and GC(t) is a control signal.

In addition, the cathode of the OLED is connected to the second power supply voltage ELVSS(t).

In FIG. 10, the first through third pixel transistors M1 through M3 are implemented with P-type metal oxide semiconductor (PMOS) transistors.

As described above, each pixel 140*a* according to the present embodiment is driven in a simultaneous emission manner. The method of driving the pixel 140*a* includes operations to be performed for each frame: initialization Init, resetting Reset, compensating for a threshold voltage Vth, scanning/data inputting Scan, emitting Emission, and non-emitting Off, as illustrated in FIGS. 11A through 11C.

In this regard, in the scanning/data inputting operation Scan, the scan signal Scan(i) is input to a scan line, and the data voltage Data(j) corresponding to the scan signal Scan(i) is input to each pixel 140*a*. However, in the other operations, signals having predetermined voltage levels, i.e., the first power supply voltage ELVDD(t), the second power supply voltage ELVSS(t), the scan signal Scan(i), the control signal GC(t), and the data voltage Data(j) are applied to each pixel 140*a* of the pixel unit 130 all together at the same time.

In other words, the operation of compensating for a threshold voltage of a driving transistor included in each pixel 140*a*, i.e., the second pixel transistor M2, and the emitting operation of each pixel 140*a* are performed simultaneously by all pixels 140*a* of the pixel unit 130 for each frame.

FIGS. 11A through 11C are driving timing diagrams of the pixel 140*a* illustrated in FIG. 10. In the present embodiment, the first power supply voltage ELVDD(t) and the second power supply voltage ELVSS(t) may be implemented in three manners, as illustrated in FIGS. 11A through 11C.

First, referring to FIG. 11A, the first power supply voltage ELVDD(t) is applied as voltage values having three different levels, for example, 12 V, 2 V, and −3 V, and the second power supply voltage ELVSS(t) is applied at a fixed low level, for example, V, and the data voltage Data(j) is in the range of 0 to 6 V.

In this case, since the second power supply voltage ELVSS (t) has a predetermined voltage level, for example, a ground voltage level, the second power supply voltage generation unit 220*a* or 220*b* does not need to be separately implemented, and circuit cost thereof may be reduced. Contrary to this, since the first power supply voltage ELVDD(t) must have a negative voltage value, for example, −3 V, from among the three levels, the circuit configuration of the first power supply voltage generation unit 210*a* or 210*b* may be complicated. In this case, the first resistor R1 may be connected between the gate of a transistor for pulling-down the first power supply voltage ELVDD(t) and a power supply voltage control signal input line connected to the gate of the transistor.

In addition, when the pixel 140*a* is driven at a signal waveform illustrated in FIG. 11A, the scan signal Scan(i) may be applied at three levels, i.e., "high level H, high level H, and high level H", "high level H, low level L, high level H", or "low level L, low level L, low level L", respectively. This will be described later with reference to FIGS. 12B through 12D in more detail.

Next, referring to FIG. 11B, the first power supply voltage ELVDD(t) is applied at two levels, for example, 12 V and 0 V, and the second power supply voltage ELVSS(t) is also applied at two levels, for example, 0 V and 12 V, and the data voltage Data(j) is in the range of 0 to 12 V.

Next, referring to FIG. 11C, the present embodiment relates to a reverse manner to the embodiment of FIG. 11A, and the first power supply voltage ELVDD(t) is applied as a fixed voltage level, for example, a high voltage level, e.g., 12 V, and the second power supply voltage ELVSS(t) is applied as three voltage levels, for example, 0 V, 10 V, and 15 V.

In this case, since the first power supply voltage ELVDD(t) has a constant voltage level, for example, 12 V, the first power supply voltage generation unit 210*a* or 210*b* does not need to be separately implemented, and circuit cost thereof may be reduced. Contrary to this, since the second power supply voltage ELVSS(t) must have three voltage levels, the circuit configuration of the second power supply voltage generation unit 220*a* or 220*b* may be complicated. In this regard, the second resistor R2 may be connected between a gate of a transistor for pulling-down the second power supply voltage ELVSS(t) and a power supply voltage control signal input line connected to the gate of the transistor.

FIGS. 12A through 12J are driving timing diagrams of a method of driving the organic light-emitting display apparatus 100, according to another embodiment. Hereinafter, a simultaneous emission type driving method will be described with reference to FIGS. 12A through 12J in more detail.

In FIGS. 12A through 12J, a case where the scan signal Scan(i) is applied as "high level H, low level L, high level H" in the resetting operation (b) of the driving method of FIG. 11B described above will be described.

For convenience of explanation, voltage levels of input signals are described as a specific value but are arbitrary values for understanding and are not actual design values but the scope of present embodiments are not limited to the values of the voltage levels.

In addition, in the present embodiment, it is assumed that the capacity ratio of the first capacitor C1, the second capacitor C2, and the parasitic capacitor Coled of the OLED is 1:1:4.

Figure 12A:
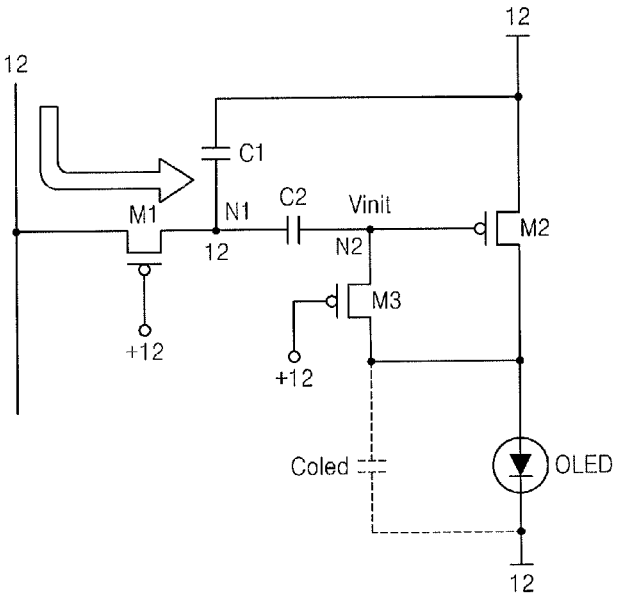
FIGS. 12A through 12J are driving timing diagrams of a method of driving an organic light-emitting display apparatus, according to another embodiment.
Figure 12A:
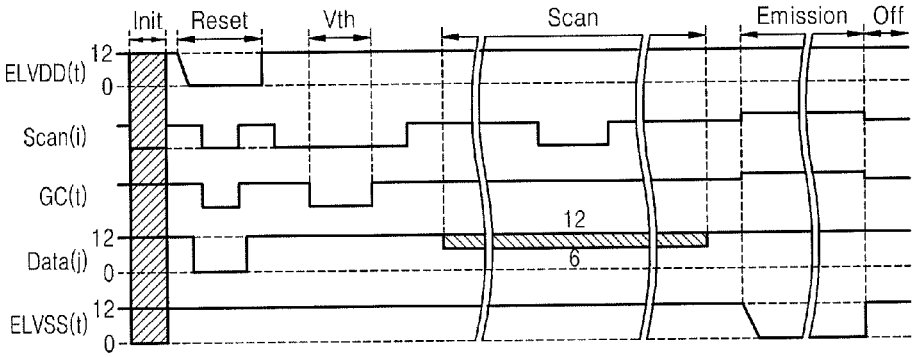

First, FIG. 12A illustrates an operation of initializing a voltage of each node for each pixel 140 of the pixel unit 130, i.e., the pixel 140*a* illustrated in FIG. 10, like in the operation (c) compensating for a threshold voltage to be subsequently performed.

In other words, in the initialization operation Init, the first power supply voltage ELVDD(t) is applied to at a high voltage level, for example, 12 V, and the scan signal Scan(i) is applied at a low voltage level, for example, −5 V, and the control signal GC(t) is applied at a high voltage level, for example, 12 V.

In addition, the data voltage Data(j) applied in the operation is an initialization voltage Vsus, and in the present embodiment, 12 V of the data voltage Data(j) is applied. In the initialization operation Init, a voltage of the second node N2 is determined by the data voltage Data(j) of a previous frame. In the present specification, it is assumed that the voltage of the second node N2 in the initialization operation Init is Vinit. Thus, a voltage difference (Vsus−Vinit) is applied to both terminals of the second capacitor C2. Although described later with reference to FIG. 12J, Vinit has a predetermined positive voltage level that is obtained by subtracting a threshold voltage of the second pixel transistor M2 from a data voltage corresponding to an input image of the previous frame.

In addition, the initialization operation Init is performed by each pixel 140*a* of the pixel unit 130. Thus, signals to be applied in the initialization operation Init, i.e., the first power supply voltage ELVDD(t), the second power supply voltage ELVSS(t), the scan signal Scan(i), the control signal GC(t), and the data voltage Data(j) are simultaneously applied to all pixels 140*a* at predetermined voltage levels.

As the signals are applied to all pixels 140*a*, the first pixel transistor M1 and the second pixel transistor M2 are turned on, and the third pixel transistor M3 is turned off.

Thus, 12 V of an initialization signal is applied to the first node N1 through the data line Dj, and the second node has a voltage level Vinit, and the voltage difference (Vsus−Vinit) is stored in both terminals of the second capacitor C2.

Next, the resetting operation Reset will be described with reference to FIGS. 12B through 12D. The resetting operation Reset is directed to a period in which the OLED of each pixel 140*a* of the pixel unit 130, i.e., the pixel 140*a* of FIG. 10, is reset. In the resetting operation Reset, a voltage of the anode of the OLED drops to be less than a voltage of the cathode of the OLED so that the OLED may not emit.

Figure 12B:
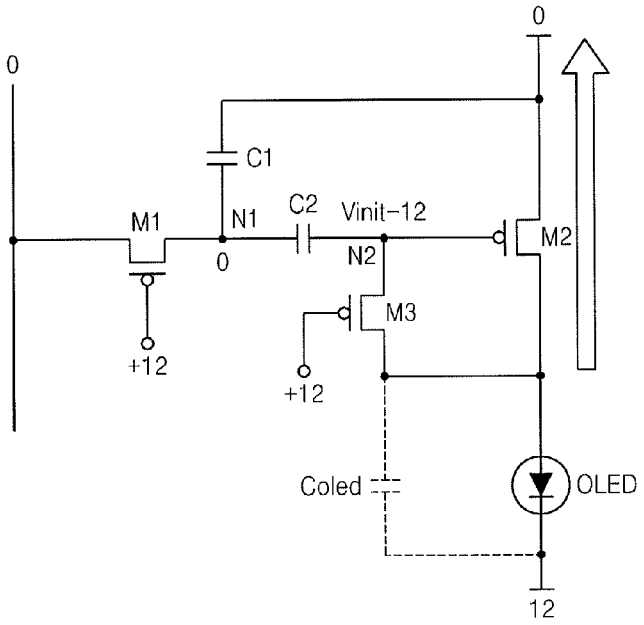
Figure 12B:
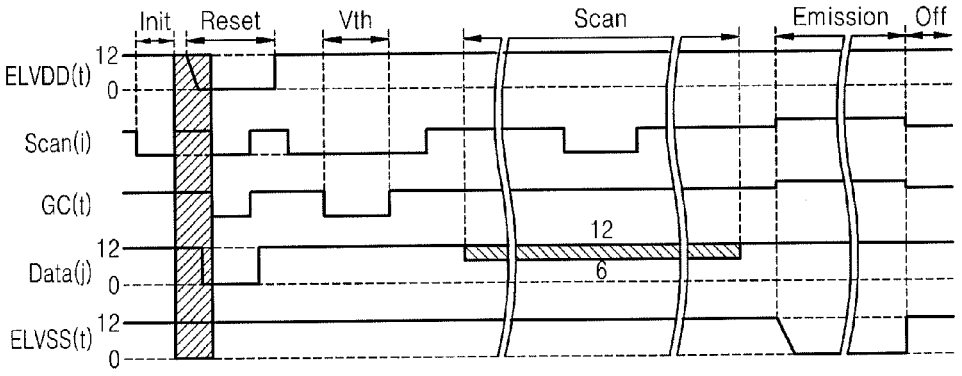
Figure 12C:
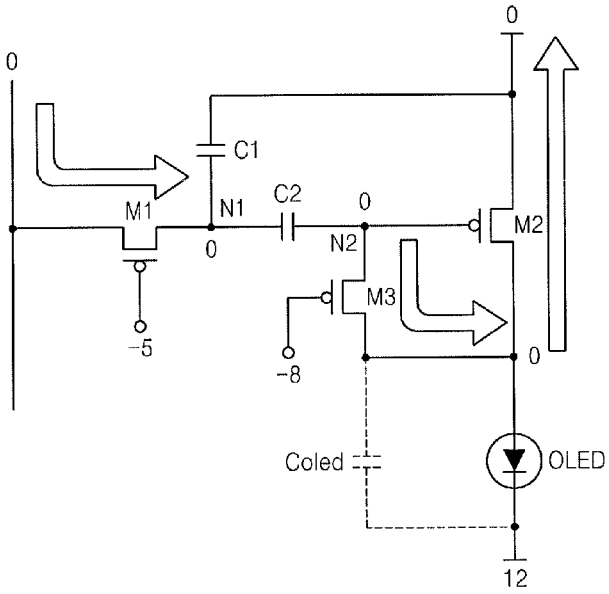
Figure 12C:
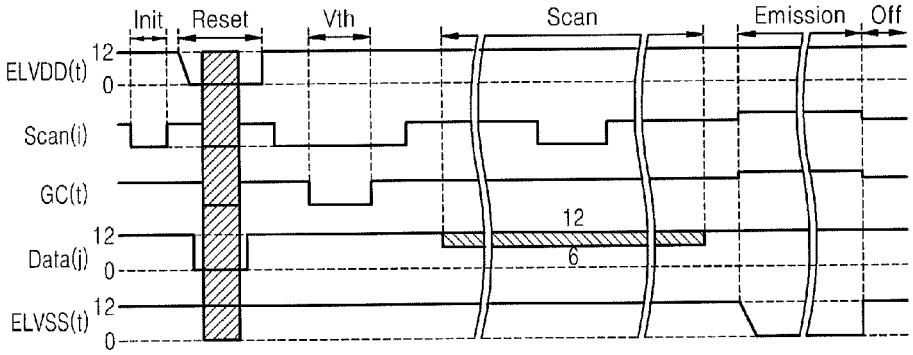
Figure 12D:
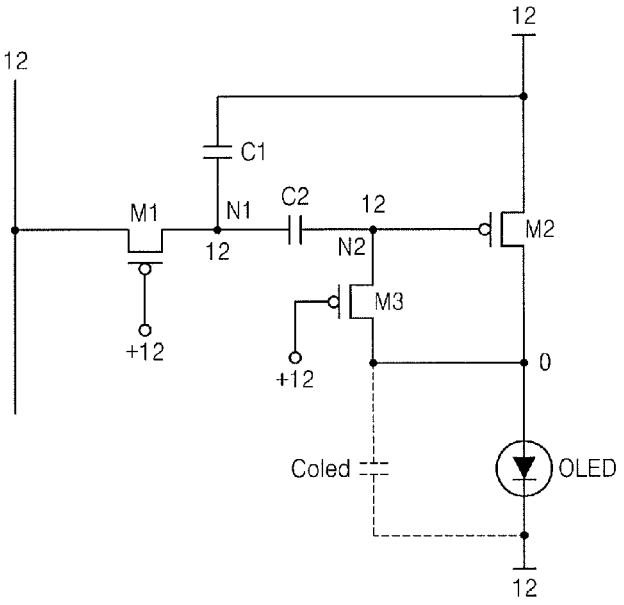
Figure 12D:
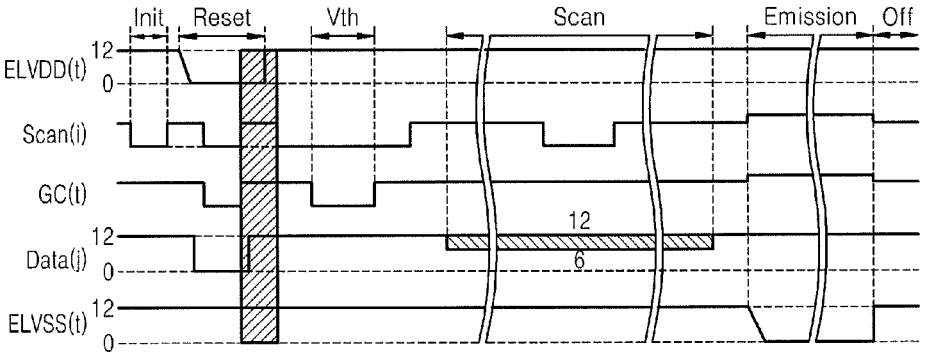

In the present embodiment, the resetting operation Reset is performed in the three stages of FIGS. 12B through 12D, respectively.

First, referring to FIG. 12B, in a first reset period, the first power supply voltage ELVDD(t) has a low voltage level, for example, 0 V, and the scan signal Scan(i) has a high level, for example, 12 V, and the control signal GC(t) has a high level, for example, 12 V.

In other words, as the scan signal Scan(i) is applied at a high level, the first pixel transistor M1 that is implemented with a PMOS is turned off. Thus, the data voltage Data(j) is applied at a lower voltage value than the voltage value of the scan signal Scan(i) in the first reset period.

When the first power supply voltage ELVDD(t) is applied as 0 V in this manner, the voltage value of the first power supply voltage ELVDD(t) supplied in the initialization operation Init of FIG. 12A, i.e., a voltage that is lower than 12 V by 12 V, is applied. Thus, due to the coupling effect of the first capacitor C1 and the second capacitor C2, the voltage of the first node N1 is lower than a voltage in the initialization operation Init by 12 V, i.e. 12 V and becomes 0 V, and the voltage of the second node N2 becomes the voltage in the initialization operation Init, i.e., is lower by 12 V than Vinit (Vinit−12 V).

However, as briefly described with reference to FIG. 11B, the scan signal Scan(i) may be applied at a low level, for example, −5 V. In this regard, since the first pixel transistor M1 is turned on, the data voltage Data(j) of 0 V is applied so that the voltage of the first node N1 may be 0 V.

In other words, considering that, in view of design limitation conditions, the voltages of the first node N1 and the second node N2 are not sufficiently decreased to desired degrees due to parasitic coupling, the scan signal Scan(i) may be at a low level, and the data voltage Data(j) corresponding to the scan signal Scan(i) may be applied as 0V.

When the voltage of the second node N2 becomes Vinit−12 V, a voltage applied to the gate of the second pixel transistor M2 connected to the second node N2 becomes Vinit−12 V, and thus, the second pixel transistor M2 that is implemented with a PMOS is turned on.

In other words, as a current path between the first and second terminals of the second pixel transistor M2 is formed, a voltage charged in the parasitic capacitor Coled of the anode of the OLED connected to the second terminal of the second pixel transistor M2 is gradually decreased to the voltage value of the first power supply voltage ELVDD(t), i.e. 0 V.

However, when a current flows from the parasitic capacitor Coled to a ground line through the first power supply line ELVDD and the first power supply voltage generation units 210*a* and 210*b*, in order to charge the parasitic capacitor Coled, a surge current may be generated from the DC power supply voltage Vdc through the second power supply voltage generation units 220*a* and 220*b* and the second power supply line ELVSS. Since the surge current is approximately proportional to the sum of capacitance of the parasitic capacitor Coled of all pixels 140*a* of the pixel unit 130, the magnitude of the surge current is very large. In the present embodiment, in a first reset period, the speed of decreasing the first power supply voltage ELVDD(t) is reduced so that the surge current may be prevented from being generated in the organic light-emitting display apparatus 100.

Next, referring to FIG. 12C, in a second reset period, the first power supply voltage ELVDD(t) is applied at a low voltage level, for example, 0 V, and the scan signal Scan(i) is applied at a low voltage level, for example, −5 V, and the control signal GC(t) is applied at a low voltage level, for example, −8 V. In this regard, since the first pixel transistor M1 is turned on, 0 V of the data voltage Data(j) in the resetting operation Reset is applied to the first node N1. In addition, as the second and third pixel transistors M2 and M3 are turned on, 0 V, which is the voltage of the first power supply voltage ELVDD(t), is applied to the second node N2 and the anode of the OLED. Thus, the voltage value of the anode of the OLED is maintained less than the voltage value of the cathode of the OLED.

In other words, compared to the first reset period, in the second reset period, the scan signal Scan(i) is at a low level, for example, −5 V, and the data voltage Data(j) corresponding to the scan signal Scan(i) is applied as 0 V. This is because, as described above, the case where, in view of design limitation conditions, the voltages of the first node N1 and the second node N2 are not sufficiently decreased due to parasitic coupling, has been considered.

In addition, during the second reset period, the scan signal Scan(i) having a high level may be applied. In this regard, in the second reset period, the scan signal Scan(i) may be maintained to have the same waveform as in the first reset period. In other words, in the second reset period, the scan signal Scan(i) may be applied at a high level and may be maintained at a voltage level of the initialization operation Vinit, i.e., at a voltage level Vsus.

Next, referring to FIG. 12D, in the third reset period, the first power supply voltage ELVDD(t) is applied at the high voltage level, for example, 12 V, and the scan signal Scan(i) is applied at a high level, for example, 12 V, and the control signal GC(t) is applied at a high level, for example, 12 V.

In other words, the same case occurs again that first power supply voltage ELVDD(t) having the same voltage value as in the initialization operation Init described in FIG. 12A may be applied in the third reset period. Thus, since the voltage value of the first power supply voltage ELVDD(t) is increased by 12 V, compared to the second reset period, due to the coupling effect of the first capacitor C1 and the second capacitor C2, the voltages of the first node N1 and the second node N2 are increased by 12 V and 12 V, respectively.

In other words, the voltage of each of the first and second nodes N1 and N2 and the value of the first power supply voltage ELVDD(t) are the same as in the initialization operation Init of FIG. 12A.

The voltage value of the anode of the OLED applied in the first through third reset periods is a voltage value of the cathode of the OLED, i.e., 0 V that is lower than 12V.

In addition, even in the third reset period, the scan signal Scan(i) may be applied at a low level, for example, −5 V. However, the data voltage Data(j) corresponding to the scan signal Scan(i) may be applied as 12 V so that the voltage of the first node N1 may be maintained at 12 V.

The reset operation Reset illustrated in FIGS. 12B through 12D is performed by each pixel 140*a* of the pixel unit 130 all together at the same time Thus, the signals applied in the first through third reset periods, i.e., the first power supply voltage ELVDD(t), the second power supply voltage ELVSS(t), the scan signal Scan(i), the control signal GC(t), and the data voltage Data(j) must be applied to all pixels 140*a* at predetermined voltage levels simultaneously in each of the first through third reset periods.

Figure 12E:
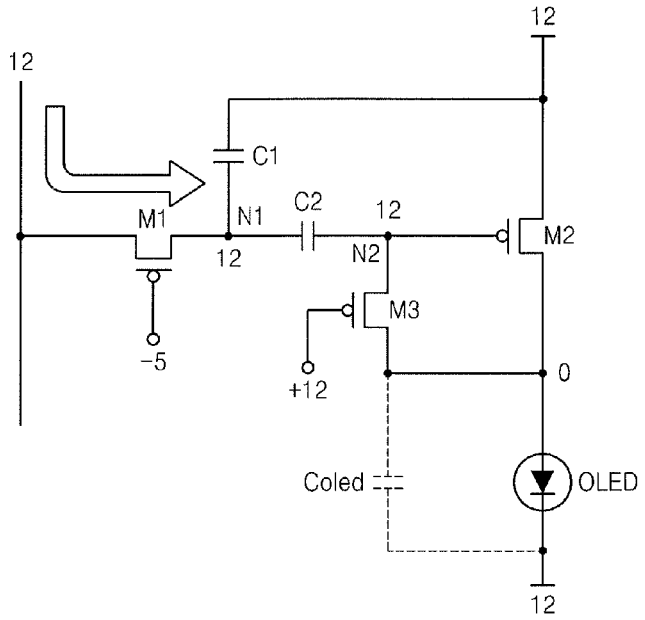
Figure 12E:
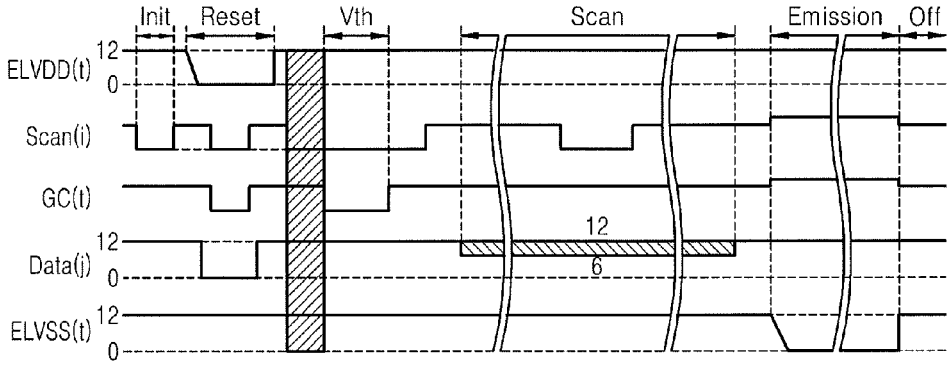
Figure 12F:
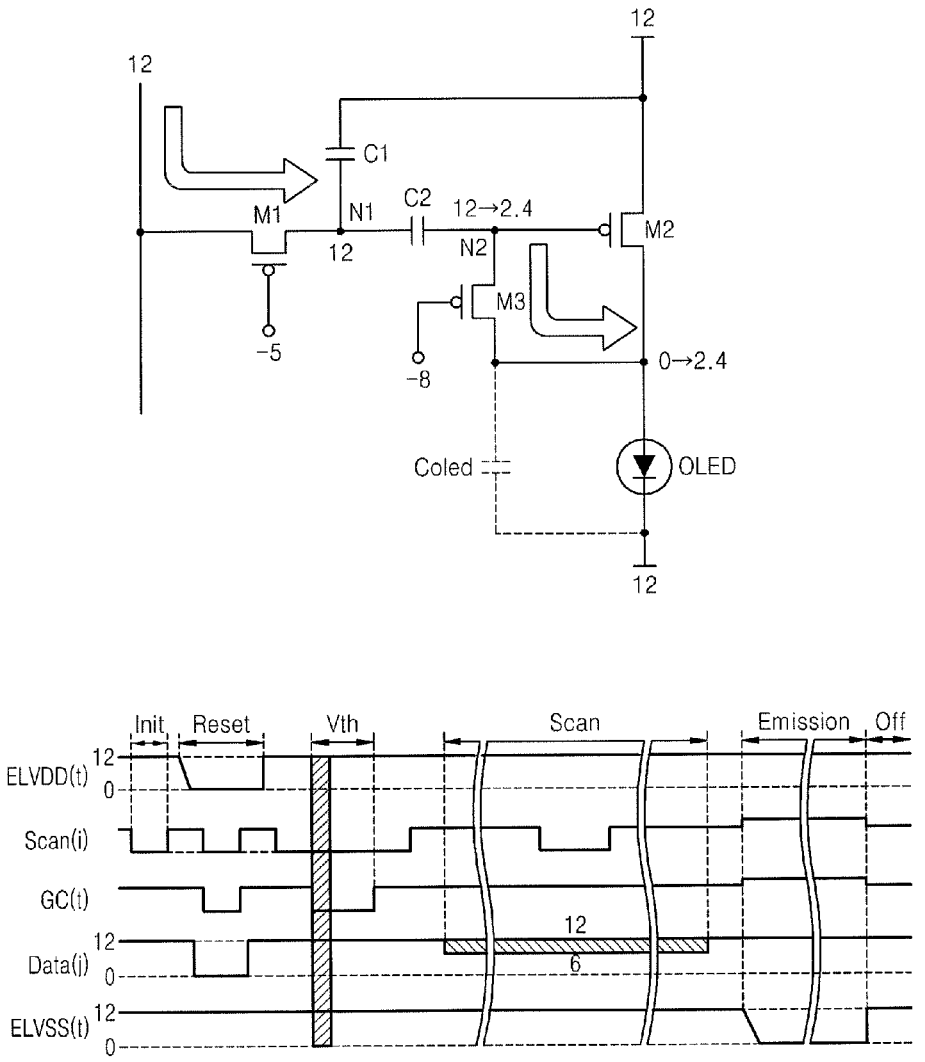
Figure 12G:
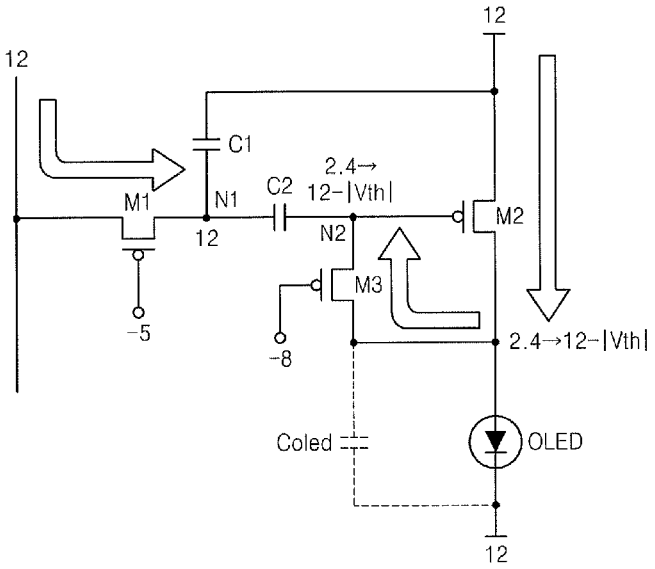
Figure 12G:
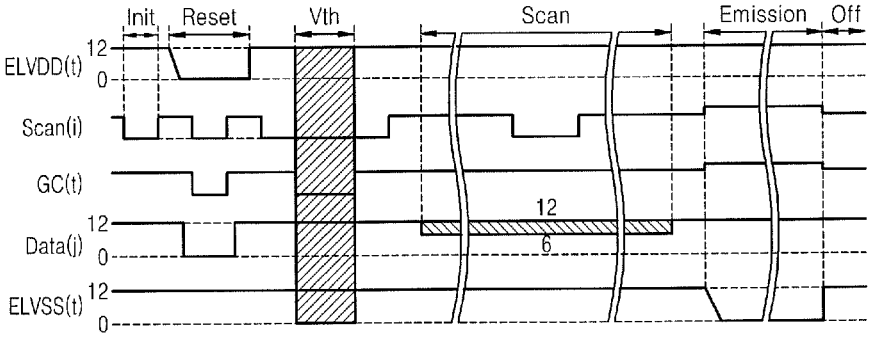

Next, referring to FIGS. 12E through 12G, in a period in which a threshold voltage of the driving transistor included in each pixel 140*a* of the pixel unit 130, i.e., a threshold voltage of the second pixel transistor M2, is stored in the second capacitor C2, defects caused by a threshold voltage difference of the driving transistor may be removed when the data voltage Data(j) is charged in each pixel 140*a*.

In the present embodiment, the operation of compensating for a threshold voltage is performed in three stages of FIGS. 12E through 12G, respectively.

First, referring to FIG. 12E, a first threshold voltage compensating-for period is a period in which the threshold voltage of the driving transistor, i.e., the second pixel transistor M, is stored. Thus, a difference between the period of FIG. 12E and the period of FIG. 12D is in that the scan signal Scan(i) is applied at a low level of −5 V in the period of FIG. 12E. In this regard, since the first pixel transistor M1 is turned on, the data voltage Data(j) is applied to the first terminal of the first pixel transistor M1 at 12 V, which is the same as the voltage of the first node N1 of FIG. 12D.

In the first threshold voltage compensating-for period, like in the third reset period, the scan signal Scan(i) may be applied at a high level so as to prevent the voltages of the first and second nodes N1 and N2 from being out of a predetermined value.

FIG. 12F illustrates a second threshold voltage compensating-for period in which a voltage level of the second node N2 is pulled down.

To this end, the first power supply voltage ELVDD(t) and the scan signal Scan(i) are applied at the high voltage level (12 V) and the low level (−5 V), respectively, like in the previous period, and the control signal GC(t) is applied at the low level, for example, −8 V.

In other words, as the first power supply voltage ELVDD(t) and the scan signal Scan(i) are applied, the third pixel transistor M3 is turned on. As the third pixel transistor M3 is turned on, the gate and the second terminal of the second pixel transistor M2 are electrically connected to each other so that the second pixel transistor M2 may act as a diode.

Thus, the voltage level of the second node N2, i.e., the gate of the second pixel transistor M2, is dropped by a ratio of Coled/(C2+Coled) due to the coupling effect of the second capacitor C2 and the parasitic capacitor Coled of the OLED.

As described above, if it is assumed that the capacity ratio of the second capacitor C2 to the parasitic capacitor Coled is 1:4, a difference between the voltage of the second node N2 and the anode voltage of the OLED is 12 V, and the voltage of the second node N2 is decreased by ⅘ of the voltage difference due to the coupling effect of the second capacitor C2 and the parasitic capacitor Coled, and thus, the voltage level of the second node N2 is 12 V*(⅕)=2.4V. In addition, due to the third pixel transistor M3, the anode voltage of the OLED that is electrically connected to the second node N2 is also 2.4 V.

After that, FIG. 12G illustrates a third threshold voltage compensating-for period in which the waveform of an applied signal is the same as in the second threshold voltage compensating-for period.

As described above in the second threshold voltage compensating-for period, if the voltage of the second node N2 is 2.4 V, Vgs of the second pixel transistor M2, i.e., (2.4 V-12 V), is less than Vth. Thus, the second pixel transistor M2 is turned on until the voltage difference between the first power supply voltage ELVDD(t) and the anode voltage of the OLED corresponds to the magnitude of the threshold voltage of the second pixel transistor M2, and a current flows through the second pixel transistor M2, and then, the second pixel transistor M2 is turned off. In the organic light-emitting display apparatus 100, a threshold voltage difference of the second pixel transistor M2 of each pixel 140*a* may occur. In the third threshold voltage compensating-for period, the threshold voltage difference of each pixel 140*a* is reflected on the voltage of the second node N2.

For example, when the first power supply voltage ELVDD (t) is applied as 12 V and the threshold voltage of the second pixel transistor M2 is −2 V, a current flows through the second pixel transistor M2 until the anode voltage of the OLED is 10 V. In addition, a current path is formed between the second node N2 and the OLED due to the third pixel transistor M3, and thus, the voltage of the second node N2 is also 10 V.

In addition, the first through third threshold voltage compensating-for operations are also performed by each pixel 140*a* of the pixel unit 130 all together at the same time. Thus, signals applied in the threshold voltage compensating-for operation, i.e., the first power supply voltage ELVDD(t), the second power supply voltage ELVSS(t), the scan signal Scan (i), the control signal GC(t), and the data voltage Data(j) are applied to all pixels 140*a* simultaneously at predetermined voltage levels.

Figure 12H:
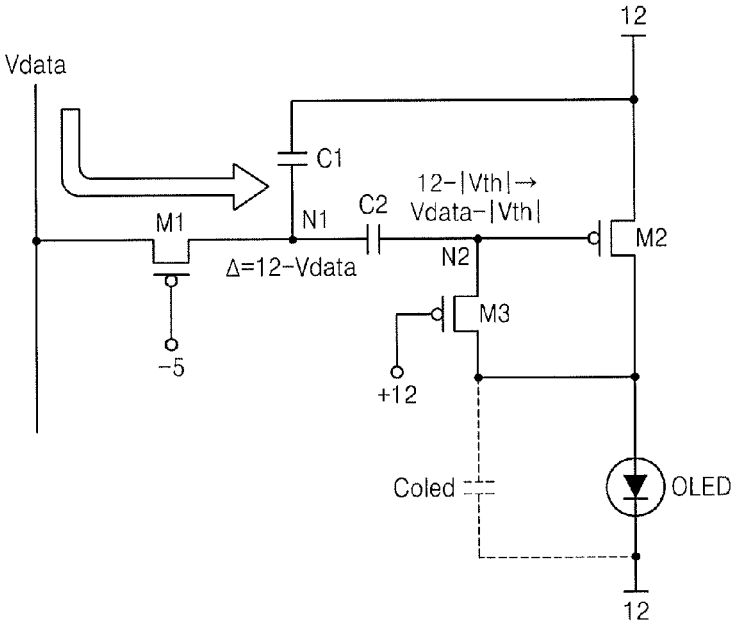
Figure 12H:
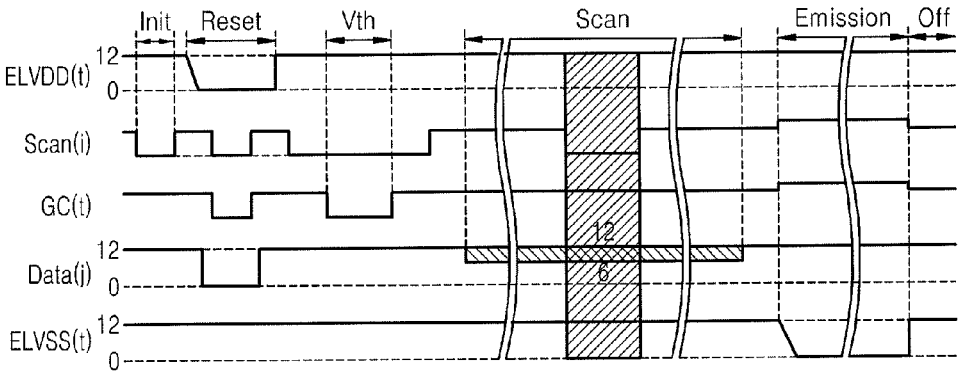
Figure 12I:
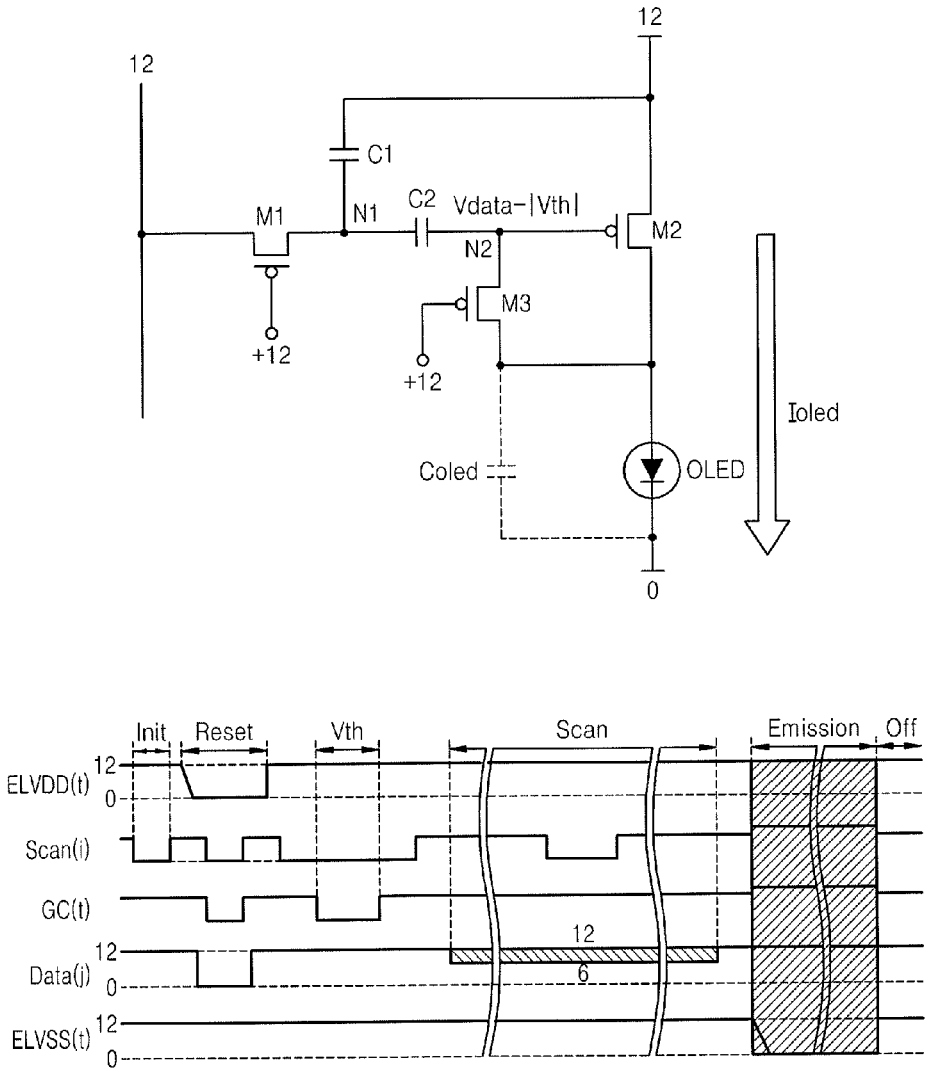

Next, referring to FIG. 12H, the scan signal Scan(i) is applied to each pixel 140*a* connected to each of the scan lines S1 through Sn of the pixel unit 130. Thus, the data voltage Data(j) is applied to each pixel 140*a* through each of the data lines D1 through Dm.

In other words, in the scanning/data inputting operation illustrated in FIG. 12H, the scan signal Scan(i) is input to each of the scan lines S1 through Sn, and the data voltage Data(j) corresponding to the scan signal Scan(i) is input to the pixel 140*a* connected to each of the scan lines S1 through Sn, and during the scanning/data inputting operation, the control signal GC(t) is applied at a high level, for example, 12 V.

For example, as illustrated in FIG. 12H, the width of the scan signal Scan(i) may be set as 2 horizontal times 2H. In other words, the width of an (i−1)-th scan signal Scan(i−1) and the width of an i-th scan signal Scan(i) may overlap with each other by one horizontal time 1H so as to overcome a charge shortage phenomenon due to RC delay of a signal line as the size of the pixel unit 130 increases.

In addition, as the control signal GC(t) is applied at a high level, the third transistor M3 that is implemented with a PMOS is turned off.

When the scan signal Scan(i) having a low level is applied to the pixel of FIG. 12H and the first pixel transistor M1 is turned on, the data voltage Data(j) having a predetermined voltage level is applied to the first node N1 via the first and second terminals of the first pixel transistor M1.

In this regard, the data voltage Data(j) is in the range of 6 to 12 V, for example, where 6 V is a voltage value that represents white, and 12 V is a voltage value that represents black.

When the data voltage Data(j) is applied to the first node N1, the voltage of the second node N2 is decreased by a change of the voltage of the first node N1 due to the coupling effect through the second capacitor C2. The change of the voltage of the first node N1 is as follows:

$$\text{Change of the voltage of the first node } \mathbf{9}\text{i N1}=12\text{ V}-V\text{data}$$

where Vdata represents a voltage level of the data voltage Data(j) input to each pixel 140*a* during the scanning/data inputting operation and means the data voltage Data(j) corresponding to an input image. The voltage of the second node N2 due to the change of the voltage of the first node N1 is as follows:

$$\text{Voltage of the second node } \mathbf{9}\text{i N2}=(12\text{ V}-|V\text{th}|)-(V\text{sus}-V\text{data})$$

As described above, assuming that Vsus is 12 V, the voltage of the second node N2 is Vdata−|Vth|.

In addition, assuming that Vdata is in the range of 6 V to 12 V, the voltage of the second node N2 in the scanning/data inputting operation is in the range of (6 V−|Vth|) to (12 V−|Vth|). Thus, Vgs of the second pixel transistor M2 is less than Vth. Thus, the second pixel transistor M2 is maintained in a turn-on state during the scanning/data inputting operation.

Next, FIG. 121 illustrates a period in which a current Ioled corresponding to the data voltage Vdata stored in each pixel 140*a* of the pixel unit 130 is provided to the OLED of each pixel 140*a* so that the OLED may emit.

In other words, in the emitting operation Emission, the first power supply voltage ELVDD(t) is applied at the high voltage level, for example, 12 V, and the second power supply voltage ELVSS(t) is applied at the low voltage level, for example, 0 V, and each of the scan signal Scan(i) and the control signal GC(t) is applied at a high level, for example, 12 V.

Thus, as the scan signal Scan(i) is applied at the high level, the data voltage Data(j) is applied at a lower level than the voltage level of the scan signal Scan(i) so that the first pixel transistor M1 that is implemented with a PMOS may be turned off.

In addition, since the emitting operation Emission is performed by each pixel 140*a* of the pixel unit 130 all together at the same time, signals applied in the emitting operation Emission, i.e., the first power supply voltage ELVDD(t), the second power supply voltage ELVSS(t), the scan signal Scan(i), the control signal GC(t), and the data voltage Data(j), are applied to all pixels 140*a* at predetermined voltage levels simultaneously.

In addition, as the control signal GC(t) is applied at the high level, the third pixel transistor M3 that is implemented with a PMOS is turned off. Thus, the second pixel transistor M2 acts as a driving transistor.

Thus, a voltage applied to the gate of the second pixel transistor M2, i.e., the second node N2, is Vdata−|Vth|, and the first power supply voltage ELVDD(t) applied to the first terminal of the second pixel transistor M2 has a high voltage level, for example, 12 V.

As the second power supply voltage ELVSS(t) has the low voltage level, a current path from the first power supply voltage ELVDD(t) to the cathode of the OLED is formed. Thus, a current corresponding to a voltage that corresponds to the voltage value Vsg of the second pixel transistor M2, i.e., a voltage difference between the first terminal and the gate of the second pixel transistor M2, flows through the OLED, and the OLED emits light with luminance corresponding to the current.

In other words, the current flowing through the OLED is as follows:

$$I\text{oled}=\beta/2(V\text{sg}-|V\text{th}|)^2=\beta/2(12\text{ V}-(V\text{data}-|V\text{th}|)^2=\beta/2(12\text{ V}-V\text{data})^2$$

Thus, in the present embodiment, due to the current flowing through the OLED, the problem due to the threshold voltage difference of the second pixel transistor M2 may be overcome.

However, when the current flows from the parasitic capacitor Coled to a ground line through the second power supply line ELVSS and the second power supply voltage generation units 220*a* and 220*b*, in order to charge the parasitic capacitor Coled, a surge current may be generated from the DC power supply voltage Vdc to the pixel unit 130 through the first power supply voltage generation units 210*a* and 210*b* and the first power supply line ELVDD. Since the surge current is approximately proportional to the sum of the capacitance of the parasitic capacitor Coled of all pixels 140*a* of the pixel unit 130, the magnitude of the surge current is very large. In the present embodiment, in the emission period, the speed of decreasing the second power supply voltage ELVSS(t) is reduced so that the surge current may be prevented from being generated in the organic light-emitting display apparatus 100.

Figure 13:
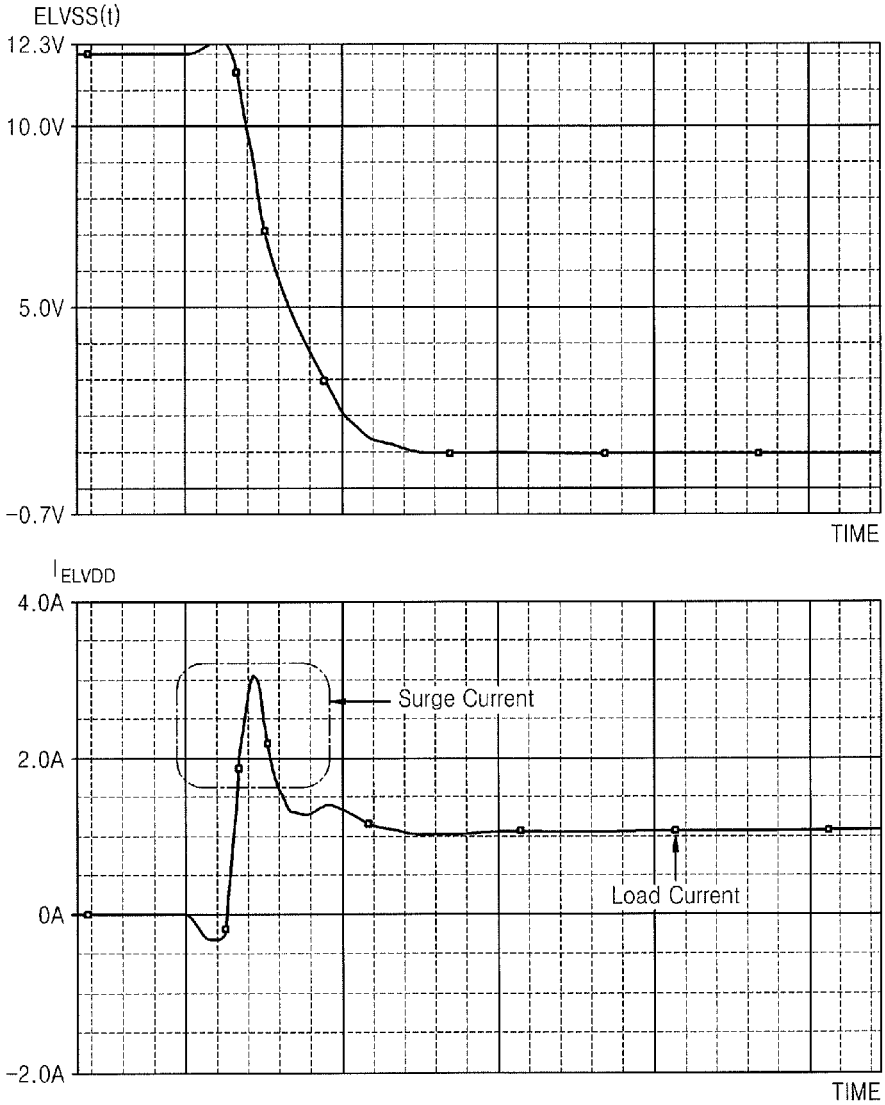
FIG. 13 is a graph showing a surge current generated when a level of a second power supply voltage drops in the absence of utilization of the present embodiments.
Figure 14:
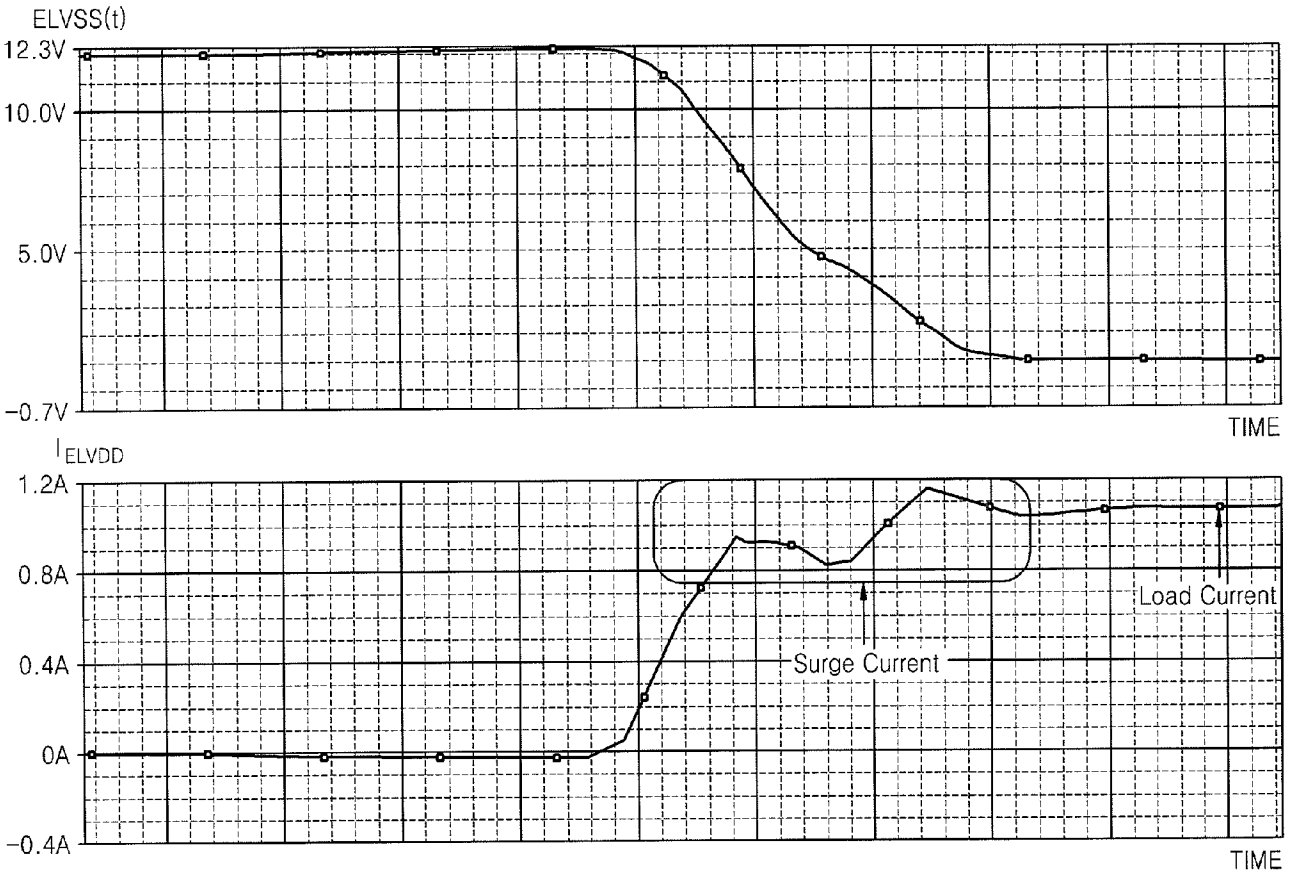
FIG. 14 is a graph showing a surge current reduction effect according to an embodiment.

FIG. 13 is a graph showing a surge current generated when a level of the second power supply voltage ELVSS(t) drops in the case of not applying embodiments, and FIG. 14 is a graph showing a surge current reduction effect according to an embodiment.

As illustrated in FIG. 13, when the second power supply voltage ELVSS(t) is dropping and a slope of the second power supply voltage ELVSS(t) has not decreased, a surge current $I_{ELVDD}$ is generated from the DC power supply voltage Vdc of the first power supply voltage generation units 210*a* and 210*b* when the second power supply voltage ELVSS(t) is dropping, and after a predetermined time has elapsed, the surge current $I_{ELVDD}$ returns to a load current level. However, when the slope of the second power supply voltage ELVSS(t) decreases according to the present embodiment, the surge current $I_{ELVDD}$ may be hardly generated by the first power supply voltage generation units 210*a* and 210*b* and may be maintained at the load current level.

Figure 12J:
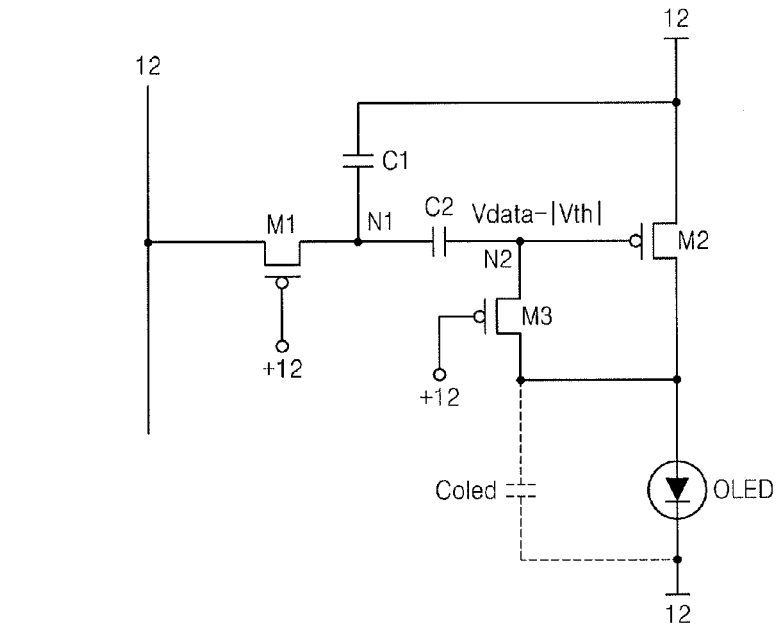
Figure 12J:
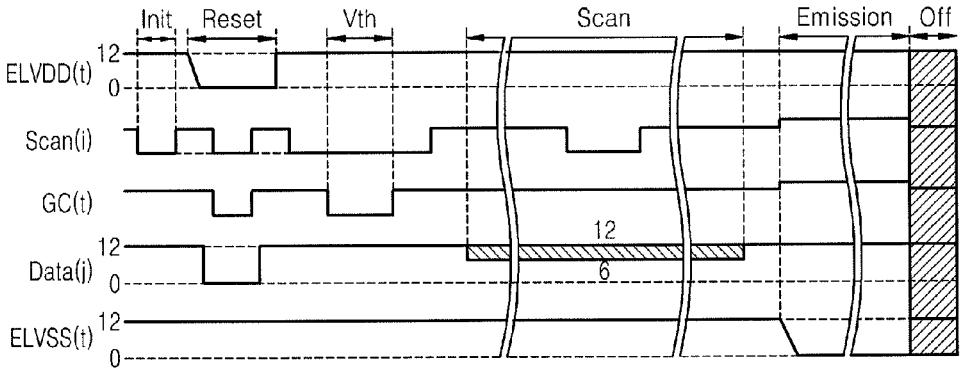

After the whole pixel unit 140 emits light, the non-emitting operation Off is performed, as illustrated in FIG. 12J.

In other words, referring to FIG. 12J, in the non-emitting operation Off, the first power supply voltage ELVDD(t) is applied at the high voltage level, for example, 12 V, and the scan signal Scan(i) is applied at a high level, for example, 12 V, and the control signal GC(t) is applied at a high level, for example, 12 V.

The non-emitting operation Off relates to a period in which the OLED is turned off for black insertion or dimming after the non-emitting operation Off is performed. The anode voltage of the OLED is decreased up to a voltage at which lighting is off within several tens of μs.

One frame is established in the periods of FIGS. 12A through 12J and is continuously circulated such that the next frame is established. In other words, after the non-emitting operation Off of FIG. 12J is performed, the initialization operation Init of FIG. 12A is performed again.

Figure 15:
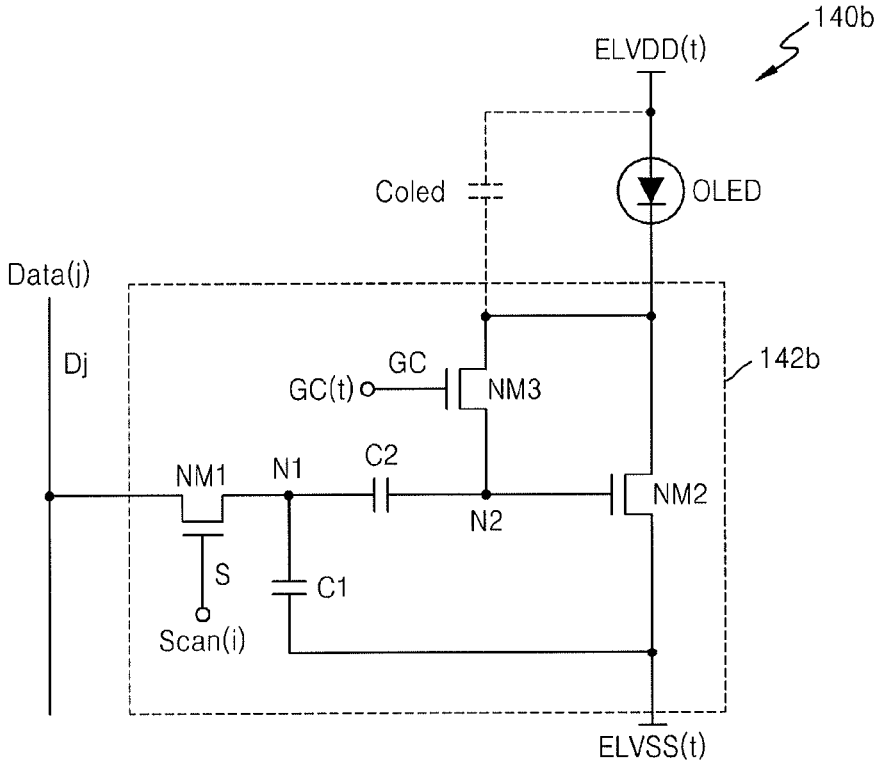
FIG. 15 is a circuit diagram of a structure of a pixel, according to another embodiment.

FIG. 15 is a circuit diagram of a structure of a pixel 140*b*, according to another embodiment.

Referring to FIG. 15, the only difference between the pixels 140 and 140*b* in FIGS. 10 and 15 is that transistors of a pixel circuit 142*b* of the pixel 140*b* is implemented as N-type metal oxide semiconductor (NMOS) transistors.

In this regard, the polarities of waveforms of the scan signal Scan(i), the control signal GC(n), the first power supply voltage ELVDD(t), the second power supply voltage ELVSS(t), and the data voltage Data(j) to be supplied in the periods other than a data writing period are switched, compared to the driving timing diagrams of FIGS. 11A through 11C.

As a result, in FIG. 15, transistors are not implemented PMOS transistors but NMOS transistors, compared to the pixel 140*a* in FIG. 10. The operation and principle of the transistors of FIG. 15 are the same as those of FIG. 10, and thus, a detailed description thereof will not be provided.

Referring to FIG. 15, the pixel 140*b* includes an OLED and the pixel circuit 142*b* for supplying a current to the OLED.

The cathode of the OLED is connected to the pixel circuit 142*b*, and the anode of the OLED is connected to the first power supply voltage ELVDD(t). The OLED generates light with a predetermined luminance in correspondence with the current supplied by the pixel circuit 142*b*.

In the present embodiment, in each pixel 140*b* of the pixel unit 130, when the scan signal Scan(i) is supplied to each of the scan lines S1 through Sn for a partial period (operation (d) described above) of one frame, the data voltage Data(j) is supplied to each of the data lines D1 through Dm. However, for the other periods (operations (a), (b), (c), (e), and (f)) of one frame, the scan signal Scan(i) applied to each of the scan lines S1 through Sn, the first power supply voltage ELVDD(t) and the second power supply voltage ELVSS(t) applied to each pixel 140*b*, and control signals applied to the control lines GC1 through GCn are applied to each pixel 140*b* at predetermined voltage levels simultaneously.

To this end, the pixel circuit 142*b* of the pixel 140*b* includes three transistors, namely, first through third transistors NM1 through NM3 and two capacitors, namely, first and second capacitors C1 and C2.

In this regard, a gate of the first pixel transistor NM1 is connected to the scan line Si, and a first terminal of the first pixel transistor NM1 is connected to the data line Dj. A second terminal of the first pixel transistor NM1 is connected to the first node N1.

In other words, the scan signal Scan(i) is input to the gate of the first pixel transistor NM1, and the data voltage Data(j) is input to the first terminal of the first pixel transistor NM1.

In addition, a gate of the second pixel transistor NM2 is connected to the second node N2, and the second terminal of the second pixel transistor NM2 is connected to the second power supply voltage ELVSS(t), and the first terminal of the second pixel transistor NM2 is connected to the cathode of the OLED. In this regard, the second pixel transistor NM2 acts as a driving transistor.

In addition, the first capacitor C1 is connected between the first node N1 and the second terminal of the second pixel transistor NM2, i.e., the second power supply voltage ELVSS (t), and the second capacitor C2 is connected between the first node N1 and the second node N2.

In addition, a gate of the third pixel transistor NM3 is connected to the control line GC, and a first terminal of the third pixel transistor NM3 is connected to the cathode of the OLED, i.e., the first terminal of the second pixel transistor NM2, and a second terminal of the third pixel transistor NM3 is connected to the gate of the second pixel transistor NM2.

Thus, the control signal GC(t) is input to the gate of the third pixel transistor NM3. When the third pixel transistor NM3 is turned on, the second pixel transistor NM2 is diode-connected.

In addition, the anode of the OLED is connected to the first power supply voltage ELVDD(t).

In FIG. 15, the first through third pixel transistors NM1 through NM3 are implemented with NMOS transistors.

By way of summation and review, organic light-emitting display apparatuses have fast response speeds and are driven with low power consumption. Organic light-emitting display apparatuses are driven by a power supply voltage applied to each of the pixels. As various methods of driving an organic light-emitting display apparatus are emerging, the organic light-emitting display apparatus may be driven by changing a level of the power supply voltage according to time. However, when the level of the power supply voltage is changed, an excessive surge current may be generated in the organic light-emitting display apparatus.

According to one or more embodiments, when a power supply voltage of an organic light-emitting display apparatus is changed, an excessive surge current may be prevented from being generated in the organic light-emitting display apparatus. In addition, according to one or more embodiments, an excessive surge current may be prevented from being generated in the organic light-emitting display apparatus so that elements of the organic light-emitting display apparatus are not destroyed. Thus, the life span of the organic light-emitting display apparatus is lengthened.

Exemplary embodiments have been disclosed herein, and although specific terms are employed, they are used and are to be interpreted in a generic and descriptive sense only and not for purpose of limitation.

What is claimed is:

1. An organic light-emitting display apparatus, comprising:

a plurality of pixels each including an organic light-emitting diode (OLED); and a power supply voltage driving unit generating a first power supply voltage having a first level that varies according to time and a second power supply voltage having a second level that varies according to time, the power supply voltage driving unit supplying the first and the second power supply voltages to the plurality of pixels, wherein the power supply voltage driving unit includes:

a first resistor connected to a gate of a second transistor for pulling-down the first power supply voltage, a second resistor connected to a gate of a fourth transistor for pulling-down the second power supply voltage, a first power supply voltage generation unit generating and outputting the first power supply voltage, the first power supply voltage generation unit including:

a first transistor including a gate connected to a first power supply voltage control signal, a first terminal connected to a direct current (DC) power supply voltage, and a second terminal connected to a first output line of the first power supply voltage, and the second transistor including a gate connected to the first resistor, a first terminal connected to the first output line of the first power supply voltage, and a second terminal connected to a ground line; and a second power supply voltage generation unit generating and outputting the second power supply voltage, the second power supply voltage generation unit including:

a third transistor including a gate connected to a third power supply voltage control signal, a first terminal connected to the DC power supply voltage, and a second terminal connected to a second output line of the second power supply voltage; and the fourth transistor including a gate connected to the second resistor, a first terminal connected to the second output line of the second power supply voltage, and a second terminal connected to the ground line, and the first resistor is connected between a second input line of a second power supply voltage control signal and the gate of the second transistor, and the second resistor is connected between a fourth input line of a fourth power supply voltage control signal and the gate of the fourth transistor.

2. The organic light-emitting display apparatus as claimed in claim 1, wherein the first resistor and the second resistor are variable resistors, the first and third transistors are p-type transistors, the second and fourth transistors are n-type transistors, and the first power supply voltage generation unit includes:

a first detector detecting a second gate level of a second gate voltage applied to the gate of the second transistor, and a first resistor controlling unit reducing a first resistance of the first resistor when a second control signal level of the second power supply voltage control signal is changed from a low level to a high level and when the second gate level of the second gate voltage applied to the gate of the second transistor exceeds a first reference voltage level; and the second power supply voltage generation unit includes:

a second detector detecting a fourth gate level of a fourth gate voltage applied to the gate of the fourth transistor, and a second resistor controlling unit reducing a second resistance of the second resistor when a fourth control signal level of the fourth power supply voltage control signal is changed from a low level to a high level and when the fourth gate level of the fourth gate voltage applied to the gate of the fourth transistor exceeds a second reference voltage level.

3. The organic light-emitting display apparatus as claimed in claim 2, wherein:

the first reference voltage level is a first reference voltage value at which a Miller effect occurs at the gate of the second transistor when the second power supply voltage control signal is changed from the low level to the high level, and the second reference voltage level is a second reference voltage value at which the Miller effect occurs at the gate of the fourth transistor when the fourth power supply voltage control signal is changed from the low level to the high level.

4. The organic light-emitting display apparatus as claimed in claim 1, wherein each of the plurality of pixels includes:

a first pixel transistor including a gate connected to scan lines, a first terminal connected to data lines, and a second terminal connected to a first node;

a second pixel transistor including a gate connected to a second node, a first terminal connected to the first power supply voltage, and a second terminal connected to an anode of the OLED;

a third pixel transistor including a gate connected to control lines, a first terminal connected to the gate of the second pixel transistor, and a second terminal connected to the second terminal of the second pixel transistor;

a first capacitor connected between the first power supply voltage and the first node;

a second capacitor connected between the first node and the second node; and the OLED including the anode connected to the second terminal of the second pixel transistor and a cathode connected to the second power supply voltage, and wherein the first through third pixel transistors are p-type transistors.

5. The organic light-emitting display apparatus as claimed in claim 4, wherein the first power supply voltage drops from a high voltage level to a low voltage level in a period in which the second pixel transistor is turned on so as to initialize an OLED voltage at the anode of the OLED.

6. The organic light-emitting display apparatus as claimed in claim 4, wherein the second power supply voltage drops from a high voltage level to a low voltage level in a period in which the second pixel transistor is turned on so that the OLED emits light.

7. The organic light-emitting display apparatus as claimed in claim 4, wherein the first power supply voltage and the second power supply voltage are commonly supplied to the plurality of pixels.

8. The organic light-emitting display apparatus as claimed in claim 4, further comprising:

a scan driving unit generating scan signals and supplying the scan signals to the plurality of pixels through the scan lines;

a data driving unit generating data voltages and supplying the data voltages to the plurality of pixels through the data lines;

a control line driving unit generating control signals for turning on the third pixel transistor in a threshold voltage compensating-for period so as to store a second capacitor voltage corresponding to a threshold voltage of the second pixel transistor in the second capacitor and supplying the control signals to the plurality of pixels through the control lines; and a timing driving unit controlling the scan driving unit, the data driving unit, the power supply voltage driving unit, and the control line driving unit.

9. The organic light-emitting display apparatus as claimed in claim 1, wherein each of the plurality of pixels includes:

a first pixel transistor including a gate connected to scan lines, a first terminal connected to data lines, and a second terminal connected to a first node;

a second pixel transistor including a gate connected to a second node, a first terminal connected to a cathode of the OLED, and a second terminal connected to the second power supply voltage;

a third pixel transistor including a gate connected to control lines, a first terminal connected to the first terminal of the second pixel transistor, and a second terminal connected to the gate of the second pixel transistor;

a first capacitor connected between the first node and the second power supply voltage;

a second capacitor connected between the first node and the second node; and the OLED including an anode connected to the first power supply voltage and a cathode connected to the first terminal of the second pixel transistor, wherein the first through third pixel transistors are n-type transistors.

10. The organic light-emitting display apparatus as claimed in claim 1, wherein resistances of the first resistor and the second resistor are determined by a sum of capacitance derived between the first power supply voltage and the second power supply voltage in the plurality of pixels.

11. A method of driving an organic light-emitting display apparatus, the organic light-emitting display apparatus including a plurality of pixels, wherein a first level of a first power supply voltage supplied to the plurality of pixels is changed according to time, and a circuitry for generating the first power supply voltage includes a first transistor for pulling-up the first power supply voltage, a second transistor for pulling-down the first power supply voltage, and a first resistor connected to a gate of the second transistor and having a variable resistance, the method comprising:

when a first control signal level of a first power supply voltage control signal supplied to the gate of the second transistor through the first resistor is changed so that the first power supply voltage is changed from a high voltage level to a low voltage level, detecting a second gate voltage applied to the gate of the second transistor;

when the second gate voltage applied to the gate of the second transistor exceeds a first reference voltage level corresponding to a Miller effect period for the second transistor, reducing a first resistance of the first resistor after the Miller effect period has elapsed to allow the second gate voltage to reach a predetermined level greater than the first reference voltage level.

12. The method as claimed in claim 11, wherein the first reference voltage level is a first reference voltage value at which the Miller effect occurs at the gate of the second transistor when the first level of the first power supply voltage control signal is changed so that the first power supply voltage is changed from the high voltage level to the low voltage level.

13. The method as claimed in claim 11, wherein a second level of a second power supply voltage supplied to the plurality of pixels is changed according to time, and a circuitry for generating the second power supply voltage includes a third transistor for pulling-up the second power supply voltage, a fourth transistor for pulling-down the second power supply voltage, and a second resistor connected to a gate of the fourth transistor and having a variable resistance, the method further comprising:

when a second control signal level of a second power supply voltage control signal supplied to the gate of the fourth transistor through the second resistor is changed so that the second power supply voltage is changed from a high voltage level to a low voltage level, detecting a fourth gate voltage applied to the gate of the fourth transistor; and if the fourth gate voltage applied to the gate of the fourth transistor exceeds a first reference voltage level, reducing a second resistance of the second resistor.

14. The method as claimed in claim 13, wherein the first and third transistors are p-type transistors and the second and fourth transistors are n-type transistors.

15. The method as claimed in claim 13, wherein the plurality of pixels includes a first node which is connected to the first power supply voltage through a first capacitor and to which a data voltage is applied through a first pixel transistor, a second node connected to the first node through a second capacitor and connected to the gate of a second pixel transistor, the second pixel transistor is connected between the first power supply voltage and an anode of an organic light-emitting diode (OLED), a third pixel transistor is connected between the gate of the second pixel transistor and a second terminal of the second pixel transistor and thereby diode-connecting the second pixel transistor according to a control signal, and the second power supply voltage is connected to a cathode of the OLED, the method further comprising:

a resetting operation of supplying the first and second power supply voltages having the high voltage level to the plurality of pixels and initializing a first node voltage value;

an initialization operation of dropping the first power supply voltage from the high voltage level to the low voltage level, initializing an anode voltage value of the OLED to the low voltage level and then rising the first power supply voltage to the high voltage level;

a threshold voltage compensating-for operation of diode-connecting the second pixel transistor by turning on the third pixel transistor and storing a second capacitor voltage value corresponding to a threshold voltage of the second pixel transistor in the second capacitor;

a scanning/data inputting operation of sequentially turning on the first pixel transistor of the plurality of pixels to store the data voltage in the first capacitor of the plurality of pixels; and an emission operation of allowing the OLED to emit light by dropping the second power supply voltage to the low voltage level.

16. The method as claimed in claim 15, wherein the first through third pixel transistors are p-type transistors.

17. The method as claimed in claim 15, further comprising, after the emission operation of allowing the OLED to emit light, a non-emitting operation of turning off the OLED by rising the second power supply voltage up to the high voltage level.

18. The method as claimed in claim 13, wherein the first power supply voltage and the second power supply voltage are commonly supplied to the plurality of pixels.

19. The method as claimed in claim 13, wherein resistances of the first resistor and the second resistor are determined by a sum of capacitance derived between the first power supply voltage and the second power supply voltage in the plurality of pixels.

* * * * *